US011622600B2

(12) United States Patent
Hoffer et al.

(10) Patent No.: US 11,622,600 B2
(45) Date of Patent: Apr. 11, 2023

(54) ARTICLE OF FOOTWEAR

(71) Applicant: NIKE, Inc., Beaverton, OR (US)

(72) Inventors: Kevin W. Hoffer, Portland, OR (US); Cassidy R. Levy, West Linn, OR (US); Brian Linkfield, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 50 days.

(21) Appl. No.: 16/933,496

(22) Filed: Jul. 20, 2020

(65) Prior Publication Data

US 2021/0022438 A1 Jan. 28, 2021

Related U.S. Application Data

(60) Provisional application No. 62/923,658, filed on Oct. 21, 2019, provisional application No. 62/878,682, filed on Jul. 25, 2019.

(51) Int. Cl.

| | |
|---|---|
| ***A43B 13/12*** | (2006.01) |
| ***A43B 23/02*** | (2006.01) |
| ***A43B 13/16*** | (2006.01) |
| ***A43B 9/02*** | (2006.01) |
| ***A43B 13/41*** | (2006.01) |

(52) U.S. Cl.

CPC ..... *A43B 13/125* (2013.01); *A43B 9/02* (2013.01); *A43B 13/122* (2013.01); *A43B 13/16* (2013.01); *A43B 13/41* (2013.01); *A43B 23/025* (2013.01)

(58) Field of Classification Search

CPC ..... A43B 23/025; A43B 13/41; A43B 13/38; A43B 13/383; A43B 13/386; A43B 13/40; A43B 9/02

See application file for complete search history.

(56) References Cited

U.S. PATENT DOCUMENTS

| | | | | |
|---|---|---|---|---|
| 2,930,149 A | | 3/1960 | Hack | |
| 3,032,898 A | * | 5/1962 | Servin | A43B 3/101 36/9 R |
| 3,087,262 A | | 4/1963 | Russell | |

(Continued)

FOREIGN PATENT DOCUMENTS

| | | |
|---|---|---|
| CH | 283034 A | 5/1952 |
| CN | 1053884 A | 8/1991 |

(Continued)

OTHER PUBLICATIONS

European Patent Office as the International Searching Authority, International Search Report and Written Opinion for PCT Application No. PCT/US2016/053256, dated Jan. 12, 2017.

(Continued)

*Primary Examiner* — Khoa D Huynh
*Assistant Examiner* — Haley A Smith
(74) *Attorney, Agent, or Firm* — Honigman LLP; Matthew H. Szalach; Jonathan P. O'Brien

(57) ABSTRACT

An article of footwear includes a strobel having an interior surface and an exterior surface formed on an opposite side from the interior surface, the strobel defining a footbed and a peripheral wall extending transversely from the footbed to a terminal edge. The article of footwear additionally includes an upper attached to the terminal edge of the strobel along a peripheral seam to define an interior void for receiving a foot, the peripheral seam configured to extend along a side of the interior void.

20 Claims, 14 Drawing Sheets

(56) References Cited

U.S. PATENT DOCUMENTS 3,469,576 A 9/1969 Everts et al.
3,552,044 A 1/1971 Wiele
3,608,215 A 9/1971 Fukuoka
3,724,106 A 4/1973 Magidson
3,765,422 A 10/1973 Smith
3,906,570 A 9/1975 Revill
3,971,839 A 7/1976 Taylor
4,170,078 A 10/1979 Moss
4,307,200 A 12/1981 Lichter et al.
4,343,047 A 8/1982 Lazowski et al.
4,345,387 A 8/1982 Daswick
4,505,055 A * 3/1985 Bergmans ..... A43B 9/02 36/12
4,524,529 A 6/1985 Schaefer
4,658,515 A 4/1987 Oatman
4,686,781 A 8/1987 Bury
4,724,627 A 2/1988 Sisco
4,823,799 A 4/1989 Robbins
4,905,320 A 3/1990 Squyers, Jr.
4,970,807 A 11/1990 Anderie et al.
5,005,575 A 4/1991 Geri
5,150,490 A 9/1992 Busch et al.
5,231,776 A 8/1993 Wagner
5,363,570 A 11/1994 Allen et al.
5,378,223 A 1/1995 Grim et al.
5,383,290 A 1/1995 Grim
5,392,534 A 2/1995 Grim
5,517,770 A 5/1996 Martin et al.
5,617,650 A 4/1997 Grim
5,665,285 A 9/1997 Hattori et al.
5,718,064 A 2/1998 Pyle
5,753,357 A 5/1998 Filipitsch et al.
5,758,435 A 6/1998 Miyata
5,890,248 A 4/1999 Gee
5,920,915 A 7/1999 Bainbridge et al.
5,987,781 A 11/1999 Pavesi et al.
6,020,055 A 2/2000 Pearce
6,032,300 A 3/2000 Bainbridge et al.
6,061,928 A 5/2000 Nichols
6,098,209 A 8/2000 Bainbridge et al.
6,158,149 A 12/2000 Rudy
6,266,896 B1 7/2001 Liu
D460,852 S 7/2002 Daudier
6,453,477 B1 9/2002 Bainbridge et al.
6,502,331 B2 1/2003 Hines
6,532,689 B1 3/2003 Jones, Jr.
6,635,203 B2 10/2003 Monaci
6,759,443 B2 7/2004 Brant et al.
6,782,640 B2 8/2004 Westin
6,848,200 B1 2/2005 Westin
6,878,753 B1 4/2005 Takemura et al.
6,928,755 B2 * 8/2005 Chen ..... A43B 9/02 36/12
6,976,320 B2 * 12/2005 McClaskie ..... A43B 3/103 12/142 C
7,037,571 B2 5/2006 Fish et al.
7,069,672 B2 7/2006 Hahn
7,152,342 B2 12/2006 Sommer
7,484,318 B2 2/2009 Finkelstein
7,555,851 B2 7/2009 Hazenberg et al.
7,594,344 B2 9/2009 Mizrahi
7,730,636 B2 * 6/2010 Auger ..... A43B 5/02 36/67 A
7,805,859 B2 10/2010 Finkelstein
7,823,238 B2 11/2010 Din Mahamed
7,904,971 B2 3/2011 Doria et al.
7,950,091 B2 * 5/2011 Auger ..... B29D 35/061 12/142 P
8,001,704 B2 * 8/2011 Baudouin ..... A43B 13/026 36/102
8,091,254 B2 1/2012 Wang
8,178,022 B2 5/2012 Schindler et al.
8,272,149 B2 9/2012 Cooper et al.
8,667,713 B2 * 3/2014 Baudouin ..... A43C 1/00 36/102
8,671,591 B2 3/2014 Brown
8,713,817 B2 5/2014 Litchfield et al.
9,591,888 B2 * 3/2017 Linth ..... A43B 13/38
9,737,111 B2 8/2017 Lustik
2001/0000835 A1 5/2001 Hines
2001/0042321 A1 11/2001 Tawney et al.
2003/0046831 A1 3/2003 Westin
2003/0079374 A1 * 5/2003 Belley ..... A43B 9/10 36/19 R
2003/0106170 A1 * 6/2003 Issler ..... A43B 23/22 12/142 C
2003/0217484 A1 11/2003 Christensen et al.
2005/0022424 A1 2/2005 Held
2005/0072024 A1 * 4/2005 Chen ..... A43B 17/18 36/12
2005/0086728 A1 4/2005 Tobergte
2005/0150132 A1 7/2005 Iannacone
2006/0010717 A1 1/2006 Finkelstein
2006/0026863 A1 2/2006 Liu
2006/0130363 A1 6/2006 Hottinger
2006/0206977 A1 9/2006 Hammons et al.
2007/0051018 A1 3/2007 Issler
2007/0169379 A1 7/2007 Hazenberg et al.
2008/0066341 A1 3/2008 Hottinger
2008/0148599 A1 6/2008 Collins
2008/0230956 A1 9/2008 Allmendinger et al.
2009/0090027 A1 * 4/2009 Baudouin ..... A43B 13/12 36/93
2009/0094855 A1 4/2009 Finkelstein
2009/0313853 A1 12/2009 Tadin
2010/0011618 A1 1/2010 Bitton
2010/0047550 A1 2/2010 Prissok et al.
2010/0154252 A1 6/2010 Avent et al.
2010/0222442 A1 9/2010 Prissok et al.
2010/0251565 A1 10/2010 Litchfield et al.
2011/0016747 A1 1/2011 Bitton
2011/0107620 A1 * 5/2011 Bell ..... A43B 23/026 36/83
2011/0209360 A1 * 9/2011 Baker ..... A43B 13/386 36/44
2011/0215497 A1 9/2011 McEvoy et al.
2012/0036698 A1 2/2012 Guertin
2012/0073163 A1 3/2012 Tse
2012/0204451 A1 8/2012 De Roode et al.
2012/0210602 A1 8/2012 Brown
2012/0291309 A1 * 11/2012 Ludemann ..... A43B 7/148 36/83
2013/0008050 A1 1/2013 Marc
2013/0133225 A1 * 5/2013 Linth ..... A43B 9/10 12/146 M
2013/0145653 A1 6/2013 Bradford
2013/0247422 A1 9/2013 Holt et al.
2014/0007456 A1 1/2014 Tadin
2014/0151918 A1 6/2014 Hartmann
2014/0223776 A1 8/2014 Wardlaw et al.
2014/0223777 A1 8/2014 Whiteman et al.
2014/0283413 A1 9/2014 Christensen et al.
2015/0196085 A1 7/2015 Westmoreland et al.
2015/0223564 A1 8/2015 Peyton et al.
2015/0257481 A1 9/2015 Campos, II et al.
2015/0264999 A1 9/2015 Marshall et al.
2016/0010717 A1 1/2016 Tosovsky
2016/0073732 A1 3/2016 Ernst et al.
2016/0157554 A1 6/2016 Adams
2016/0278481 A1 9/2016 Le et al.
2016/0353836 A1 * 12/2016 Luedecke ..... A43B 13/16
2017/0055636 A1 3/2017 Campos, II et al.
2017/0273394 A1 * 9/2017 Teixeira Roriz ... A43B 23/0295
2018/0132564 A1 5/2018 Bruce et al.
2018/0228248 A1 8/2018 Hazenberg et al.
2018/0352900 A1 12/2018 Hartmann et al.

(56) References Cited

U.S. PATENT DOCUMENTS

| | | | |
|---|---|---|---|
| 2019/0343225 | A1 | 11/2019 | Reddy et al. |
| 2019/0380424 | A1 | 12/2019 | Tamm et al. |

FOREIGN PATENT DOCUMENTS

| | | | |
|---|---|---|---|
| CN | 1211901 | A | 3/1999 |
| CN | 2620493 | Y | 6/2004 |
| CN | 1638663 | A | 7/2005 |
| CN | 2888936 | Y | 4/2007 |
| CN | 202051034 | U | 11/2011 |
| CN | 202145956 | U | 2/2012 |
| CN | 102481031 | A | 5/2012 |
| CN | 103141993 | A | 6/2013 |
| CN | 103720129 | A | 4/2014 |
| CN | 103747700 | A | 4/2014 |
| CN | 104010541 | A | 8/2014 |
| CN | 104203029 | A | 12/2014 |
| CN | 104363783 | A | 2/2015 |
| CN | 104490008 | A | 4/2015 |
| CN | 109952042 | A | 6/2019 |
| DE | 2907506 | A1 | 9/1980 |
| DE | 3406504 | A1 | 8/1985 |
| DE | 3627538 | A1 | 2/1988 |
| DE | 3723549 | A1 | 2/1988 |
| DE | 3406504 | C2 | 1/1990 |
| DE | 3839747 | A1 | 5/1990 |
| DE | 3905989 | C2 | 1/1991 |
| DE | 4202159 | A1 | 7/1993 |
| DE | 4401282 | A1 | 12/1994 |
| DE | 4446252 | A1 | 6/1995 |
| DE | 19708622 | A1 | 9/1997 |
| DE | 19938609 | A1 | 3/2001 |
| DE | 10138426 | C1 | 12/2002 |
| DE | 102009009589 | A1 | 9/2010 |
| DE | 102010046278 | A1 | 2/2011 |
| DE | 202016104626 | U1 | 10/2016 |
| EP | 0007948 | A1 | 2/1980 |
| EP | 130816 | A2 | 1/1985 |
| EP | 316289 | A2 | 5/1989 |
| EP | 0359699 | A1 | 3/1990 |
| EP | 0383685 | A1 | 8/1990 |
| EP | 529941 | A1 | 3/1993 |
| EP | 2609824 | A1 | 7/2013 |
| EP | 2649896 | B1 | 10/2016 |
| EP | 3386334 | A1 | 10/2018 |
| FR | 996111 | A | 12/1951 |
| FR | 1018215 | A | 12/1952 |
| FR | 2642941 | A1 | 8/1990 |
| FR | 2824884 | A1 | 11/2002 |
| GB | 1301147 | A | 12/1972 |
| GB | 2066049 | A | 7/1981 |
| GB | 2462100 | A | 1/2010 |
| JP | S56-080702 | U | 6/1981 |
| JP | H02-121601 | A | 5/1990 |
| JP | H02252401 | A | 10/1990 |
| JP | H05-37104 | U | 5/1993 |
| JP | H0723804 | A | 1/1995 |
| JP | H0739404 | A | 2/1995 |
| JP | 3042853 | U | 11/1997 |
| JP | H11-32806 | A | 2/1999 |
| JP | 2000316606 | A | 11/2000 |
| JP | 2002306280 | A | 10/2002 |
| JP | 2008533327 | A | 8/2008 |
| JP | 2009056007 | A | 3/2009 |
| JP | 2014033742 | A | 2/2014 |
| JP | 2015513354 | A | 5/2015 |
| JP | 2016182332 | A | 10/2016 |
| KR | 19990069793 | A | 9/1999 |
| KR | 100230096 | B1 | 11/1999 |
| KR | 200374026 | Y1 | 1/2005 |
| KR | 20100086227 | A | 7/2010 |
| KR | 20120033710 | A | 4/2012 |
| TW | 385636 | U | 3/2000 |
| WO | WO-1997035496 | A1 | 10/1997 |
| WO | WO-9947014 | A1 | 9/1999 |
| WO | WO-2006049401 | A1 | 5/2006 |
| WO | WO-2008012809 | A2 | 1/2008 |
| WO | WO-2012177957 | A2 | 12/2012 |
| WO | WO-2013013784 | A1 | 1/2013 |
| WO | WO-2014126799 | A1 | 8/2014 |
| WO | WO-2015065578 | A1 | 5/2015 |
| WO | WO-2018169535 | A1 | 9/2018 |
| WO | WO-2018175734 | A1 | 9/2018 |
| WO | WO-2020125963 | A1 | 6/2020 |

OTHER PUBLICATIONS

European Patent Office as the International Searching Authority, International Search Report and Written Opinion for PCT Application No. PCT/US2016/053240, dated Jan. 3, 2017.

European Patent Office as the International Searching Authority, International Search Report and Written Opinion for PCT Application No. PCT/US2016/053260, dated Dec. 15, 2016.

European Patent Office as the International Searching Authority, International Search Report and Written Opinion for PCT Application No. PCT/US2016/053232, dated Jan. 10, 2017.

European Patent Office as the International Searching Authority, International Search Report and Written Opinion for PCT Application No. PCT/US2016/053246, dated Jan. 10, 2017.

European Patent Office as the International Searching Authority, International Search Report and Written Opinion for PCT Application No. PCT/US2016/053265, dated Dec. 20, 2016.

United States Patent and Trademark Office, Office Action for U.S. Appl. No. 15/816,270, dated Apr. 17, 2018.

United States Patent and Trademark Office, Office Action for U.S. Appl. No. 15/816,200, dated Apr. 18, 2018.

Korean Intellectual Property Office, Office Action for Application No. 10-2018-7011476, dated May 29, 2019.

Korean Intellectual Property Office, Office Action for Application No. 10-2018-7011477, dated May 29, 2019.

Korean Intellectual Property Office, Office Action for Application No. 10-2018-7011479, dated Jun. 4, 2019.

Korean Intellectual Property Office, Office Action for Application No. 10-2018-7011480, dated Jun. 10, 2019.

Korean Intellectual Property Office, Office Action for Application No. 10-2018-7011478, dated Jun. 4, 2019.

Japan Patent Office, Notice of Reasons for Rejection for JP Application No. 2018-515812 dated Jul. 29, 2019.

Japan Patent Office, Notice of Reasons for Rejection for JP Application No. 2018-515822 dated Jul. 22, 2019.

Japan Patent Office, Notice of Reasons for Rejection for JP Application No. 2018-515842 dated Aug. 5, 2019.

Japan Patent Office, Notice of Reasons for Rejection for JP Application No. 2018-515825 dated Jul. 22, 2019.

Japan Patent Office, Notice of Reasons for Rejection for JP Application No. 2018-515843 dated Aug. 5, 2019.

Japan Patent Office, Notice of Reasons for Rejection for JP Application No. 2018-515828 dated Jul. 22, 2019.

Taiwan Intellectual Property Office, Search Report for TW Application No. 105130844 dated Aug. 27, 2019.

European Patent Office (ISA), International Search Report and Written Opinion for PCT Application No. PCT/US2017/022651, dated Oct. 25, 2017.

European Patent Office (ISA), International Search Report and Written Opinion for PCT Application No. PCT/US2017/022647, dated Nov. 2, 2017.

European Patent Office (ISA), International Preliminary Report on Patentability for International Application No. PCT/US2017/022651, dated Sep. 26, 2019.

European Patent Office (ISA), International Preliminary Report on Patentability for International Application No. PCT/US2017/022647, dated Sep. 26, 2019.

United States Patent and Trademark Office, Office Action for U.S. Appl. No. 15/574,700, dated Oct. 22, 2019.

Korean Intellectual Property Office, Office Action for KR Application No. 10-2018-7011479, dated Dec. 26, 2019.

Korean Intellectual Property Office, Office Action for KR Application No. 10-2018-7011480, dated Jan. 21, 2020.

(56) References Cited

OTHER PUBLICATIONS

European Patent Office, Extended European Search Report for EP Application No. 19196682.9, dated Jan. 2, 2020.
China National Intellectual Property Office, Office Action for CN Application No. 201680062271.7, dated Feb. 3, 2020.
Korean Intellectual Property Office, Office Action for KR Application No. 10-2019-7036063, dated Feb. 7, 2020.
China National Intellectual Property Office, Office Action for CN Application No. 201680066156.7, dated Jan. 22, 2020.
China National Intellectual Property Office, Office Action and Search Report for CN Application No. 201680062323.0, dated Mar. 4, 2020.
China National Intellectual Property Office, Office Action and Search Report for CN Application No. 201680062231.2, dated Mar. 24, 2020.
China National Intellectual Property Office, Office Action for CN Application No. 201680066534.1, dated Mar. 26, 2020.
China National Intellectual Property Office, Office Action and Search Report for CN Application No. 201680062300.X, dated Mar. 12, 2020.
European Patent Office, Communication pursuant to Article 94(3) EPC for EP Application No. 16777864.6, dated Apr. 7, 2020.
European Patent Office, Communication pursuant to Article 94(3) EPC for EP Application No. 16777865.3, dated Apr. 20, 2020.
Korean Intellectual Property Office, Office Action for KR Application No. 10-2020-7003423, dated Apr. 21, 2020.
European Patent Office, Communication pursuant to Article 94(3) EPC for EP Application No. 16777863.8, dated Apr. 15, 2020.
Japan Patent Office, Decision of Rejection for JP Application No. 2018-515812, dated Apr. 6, 2020.
European Patent Office, Extended European Search Report for EP Application No. 19212921.1, dated Mar. 31, 2020.
European Patent Office (ISA), International Search Report and Written Opinion for PCT Application No. PCT/US2020/042784, dated Sep. 17, 2020.
Ge, Chengbiao et al., Steam-chest molding of expanded thermoplastic polyuerethane bead foams and their mechanical properties, Chemical Engineering Science 174 (2017) pp. 337-346.
Japan Patent Office, Notification of Reasons for Refusal for JP Application No. 2019-550843, dated Nov. 24, 2020.
European Patent Office, Communication pursuant to Article 94(3) EPC for EP Application No. 16777864.6, dated Dec. 16, 2020.
European Patent Office, Communication pursuant to Article 94(3) EPC for EP Application No. 16777863.8, dated Dec. 22, 2020.
KS65 Luxury Light Fescue—Field Green <http://www.kodiaksports.com/Artificial-Turf/Fake-Grass/Artificial-Grass-ST65_LFS_Field, Oct. 12, 2013, (Oct. 12, 2013), Retrieved from internet: URL:https://web.archive.org/web/*/http://www.kodiaksports.com/core/media/media.nl/id.28351/c.1268496/.f?h=1c04c87e9fd3f9d67f24 [retrieved on Dec. 15, 2016].
European Patent Office as the International Searching Authority, International Search Report and Written Opinion for PCT Application No. PCT/US2020/042735, dated Sep. 16, 2020.
European Patent Office as the International Searching Authority, International Search Report and Written Opinion for PCT Application No. PCT/US2020/042784, dated Sep. 17, 2020.
European Patent Office as the International Searching Authority, International Search Report and Written Opinion for PCT Application No. PCT/US2020/042807, dated Sep. 16, 2020.
Taiwan Office Action for Application 109111247 dated Apr. 30, 2021.
Japan Patent Office, Notice of Reasons for Rejection for JP Application No. 2020-017002 dated May 31, 2021.
Japan Patent Office, Notice of Reasons for Rejection for JP Application No. 2019-550853 dated May 25, 2021.
Japanese Office Action for Application No. 2020-017000 dated May 31, 2021.
China National Intellectual Property Administration, Second Office Action for application No. 201780088457.4 dated Jul. 19, 2021.
Taiwan Intellectual Property Office, Office Action dated Sep. 3, 2021 for application No. 109125077.
Taiwan Intellectual Property Office, Office Action dated Jun. 3, 2021 for application No. 109125078.
Taiwan Intellectual Property Office, Office Action dated Jun. 3, 2021 for application No. 109125079.
China National Intellectual Property Administration, Decision of Rejection Office Action dated Jun. 29, 2021 for application No. 201680062323.0.
China National Intellectual Property Office, Office Action for Application No. 201980047915.9 dated Jul. 30, 2021.
European Patent Office, Extended European Search Report for EP Application No. 22161547.9 dated Jun. 3, 2022.
United States Patent and Trademark Office, Non-Final Office Action for U.S. Appl. No. 16/493,952 dated Jul. 22, 2022.
USPTO, Non-Final Office Action for U.S. Appl. No. 16/493,994, dated Oct. 6, 2022.

* cited by examiner

ARTICLE OF FOOTWEAR

CROSS REFERENCE TO RELATED APPLICATIONS

This non-provisional U.S. patent application claims priority under 35 U.S.C. § 119(e) to U.S. Provisional Application No. 62/878,682, filed Jul. 25, 2019 and to U.S. Provisional Application No. 62/923,658, filed Oct. 21, 2019, the disclosures of which hereby incorporated by reference in their entireties.

FIELD

The present disclosure relates to articles of footwear having a sole structure incorporating particulate matter and a bootie attached to the sole structure.

BACKGROUND

This section provides background information related to the present disclosure which is not necessarily prior art.

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

Sole structures generally include a layered arrangement extending between a ground surface and the upper. One layer of the sole structure includes an outsole that provides abrasion-resistance and traction with the ground surface. The outsole may be formed from rubber or other materials that impart durability and wear-resistance, as well as enhance traction with the ground surface. Another layer of the sole structure includes a midsole disposed between the outsole and the upper. The midsole provides cushioning for the foot and is generally at least partially formed from a polymer foam material that compresses resiliently under an applied load to cushion the foot by attenuating ground-reaction forces. The midsole may define a bottom surface on one side that opposes the outsole and a footbed on the opposite side that may be contoured to conform to a profile of the bottom surface of the foot. Sole structures may also include a comfort-enhancing insole or a sockliner located within a void proximate to the bottom portion of the upper.

Midsoles using polymer foam materials are generally configured as a single slab that compresses resiliently under applied loads, such as during walking or running movements. Generally, single-slab polymer foams are designed with an emphasis on balancing cushioning characteristics that relate to softness and responsiveness as the slab compresses under gradient loads. Polymer foams providing cushioning that is too soft will decrease the compressibility and the ability of the midsole to attenuate ground-reaction forces after repeated compressions. Conversely, polymer foams that are too hard and, thus, very responsive, sacrifice softness, thereby resulting in a loss in comfort. While different regions of a slab of polymer foam may vary in density, hardness, energy return, and material selection to balance the softness and responsiveness of the slab as a whole, creating a single slab of polymer foam that loads in a gradient manner from soft to responsive is difficult to achieve.

DRAWINGS

The drawings described herein are for illustrative purposes only of selected configurations and are not intended to limit the scope of the present disclosure.

Corresponding reference numerals indicate corresponding parts throughout the drawings.

DETAILED DESCRIPTION

Figure 1:
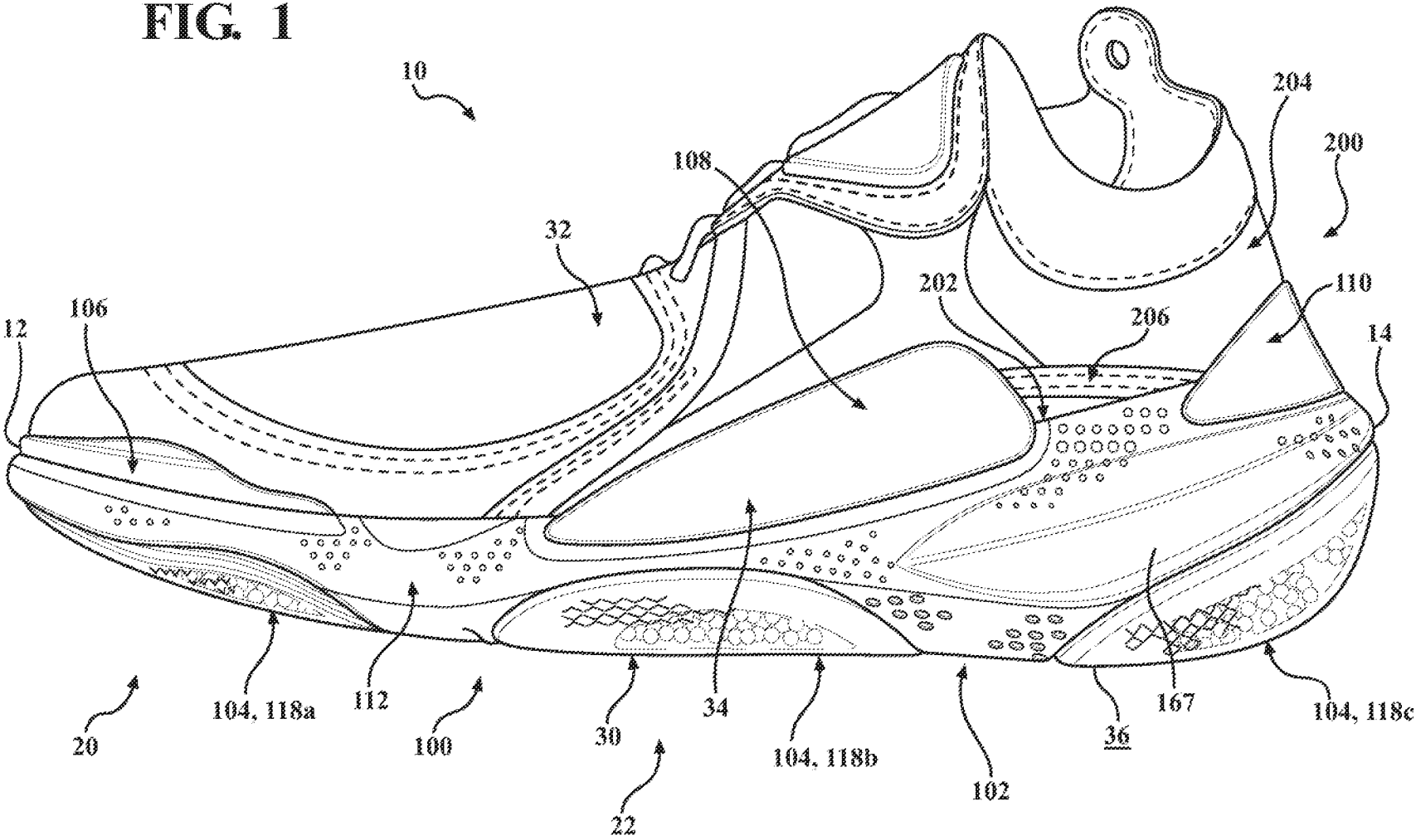
FIG. 1 is an lateral elevation view of an article of footwear in accordance with the principles of the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

In one configuration an article of footwear is provided and includes a strobel having an interior surface and an exterior surface formed on an opposite side from the interior surface, the strobel defining a footbed and a peripheral wall extending transversely from the footbed to a terminal edge. The article of footwear additionally includes an upper attached to the terminal edge of the strobel along a peripheral seam to define an interior void for receiving a foot, the peripheral seam configured to extend along a side of the interior void.

The article of footwear may additionally include one or more of the following optional features. A sole structure may be attached to the exterior surface of the footbed and may have a sidewall extending partially over the peripheral wall of the strobel, the peripheral seam being exposed above the sidewall. The strobel may be formed of a first material and the upper may be formed of a second material different than the first material.

In one configuration, the peripheral seam may include a first portion having a first stitching and a second portion having a second stitching. The first stitching may be an overlock stitching and the second stitching may be a lock stitching.

At least one reinforcement member may be attached to the footbed of the strobel. The at least one reinforcement member may include an interior reinforcement member attached to the interior surface of the strobel. The interior reinforcement member may extend from a heel region of the strobel to a mid-foot region of the strobel, and from a lateral side of the strobel to a medial side of the strobel. Further, the at least one reinforcement member may include an exterior reinforcement member attached to the exterior surface of the strobel. Further yet, the exterior reinforcement member may include a first segment extending along a lateral side of the footbed, a second segment spaced apart from the first segment and extending along a medial side of the footbed, and a third segment connecting the first segment and the second segment and extending around a heel region of the footbed.

In another configuration, an article of footwear is provided an includes a sole structure, a strobel having (i) a footbed disposed on the sole structure, and (ii) a peripheral wall extending transversely from the footbed to a terminal edge above the sole structure, and an upper attached to the terminal edge of the strobel along a peripheral seam.

The article of footwear may additionally include one or more of the following optional features. In one configuration, the peripheral seam may extend continuously around the article of footwear and may be at least partially exposed above the sole structure.

The strobel may be formed of a first material and the upper may be formed of a second material different than the first material.

The peripheral seam may include a first portion having a first stitching and a second portion having a second stitching. The first stitching may be an overlock stitching and the second stitching may be a lock stitching.

In one configuration, at least one reinforcement member may be attached to the footbed of the strobel. The at least one reinforcement member may include an interior reinforcement member attached to the interior surface of the strobel. The interior reinforcement member may extend from a heel region of the strobel to a mid-foot region of the strobel, and from a lateral side of the strobel to a medial side of the strobel. Further, the at least one reinforcement member may include an exterior reinforcement member attached to the exterior surface of the strobel. Further yet, the exterior reinforcement member may include a first segment extending along a lateral side of the footbed, a second segment spaced apart from the first segment and extending along a medial side of the footbed, and a third segment connecting the first segment and the second segment and extending around a heel region of the footbed.

Referring to FIG. 1, an article of footwear 10 includes a sole structure 100 and a bootie 200 attached to the sole structure 100. Generally, the sole structure 100 is configured to provide characteristics of cushioning and responsiveness to the article of footwear 10, while the bootie 200 is configured to receive a foot of a wearer to secure the foot of the wearer to the sole structure 100.

Figure 6:
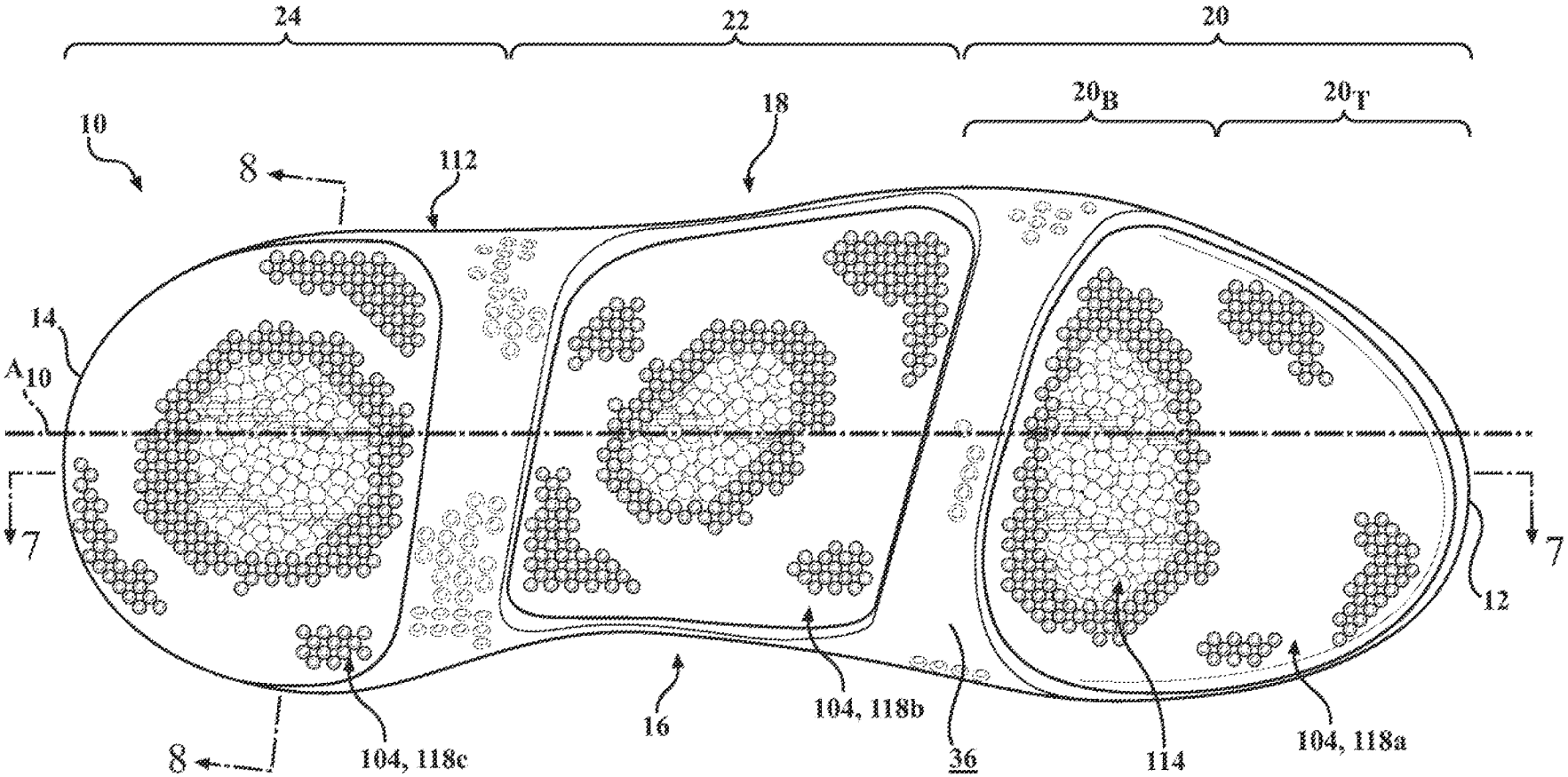
FIG. 6 is a bottom plan view of the article of footwear of FIG. 1.

The footwear 10 may further include an anterior end 12 associated with a forward-most point of the article of footwear 10, and a posterior end 14 corresponding to a rearward-most point of the footwear 10. As shown in FIG. 6, a longitudinal axis $A_{10}$ of the footwear 10 extends along a length of the footwear 10 from the anterior end 12 to the posterior end 14, and generally divides the footwear 10 into a medial side 16 and a lateral side 18. Accordingly, the medial side 16 and the lateral side 18 respectively correspond with opposite sides of the footwear 10 and extend from the anterior end 12 to the posterior end 14. As used herein, a longitudinal direction refers to the direction extending from the anterior end 12 to the posterior end 14, while a lateral direction refers to the direction transverse to the longitudinal direction and extending from the medial side 16 to the lateral side 18.

Figure 7:
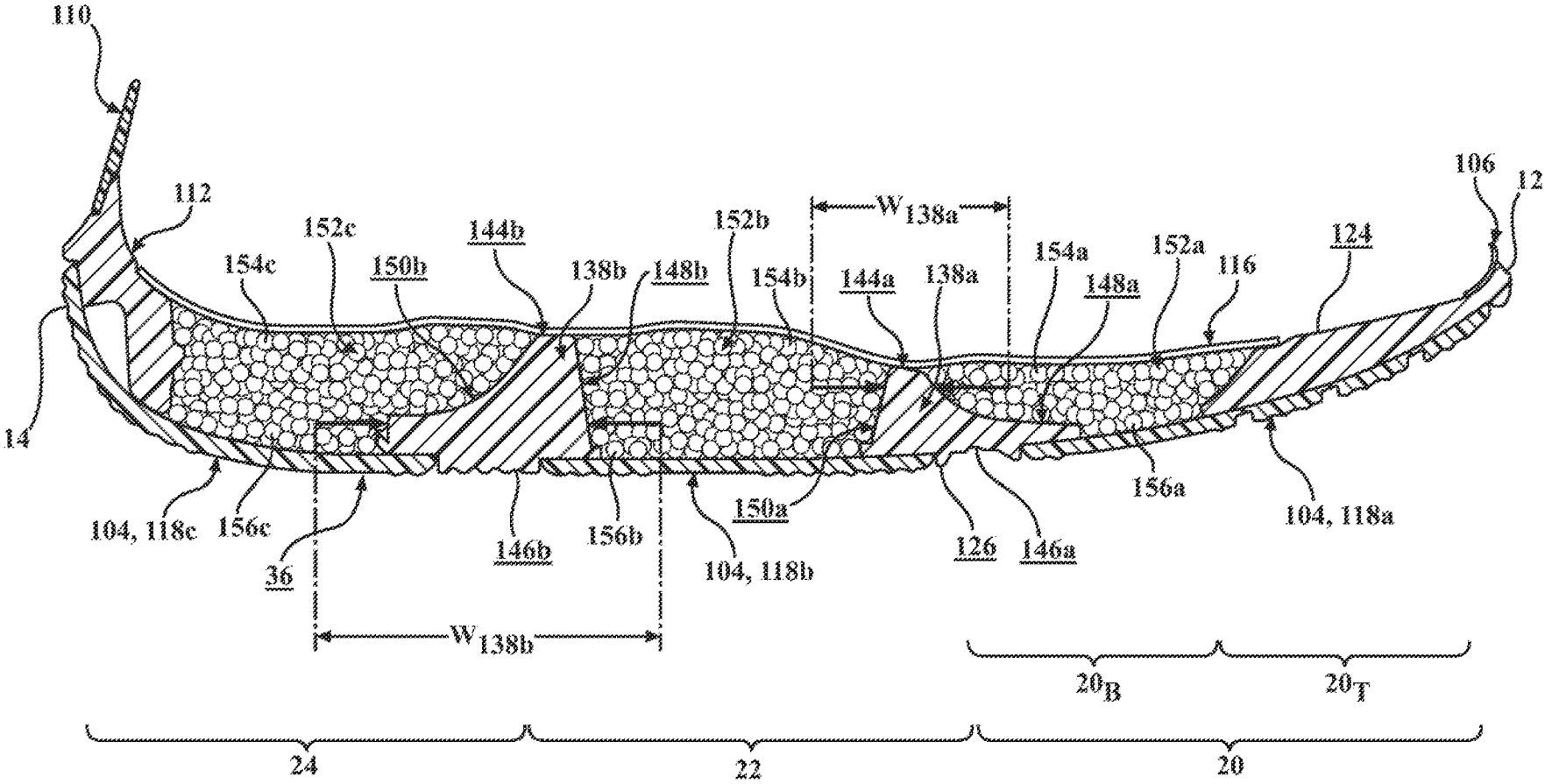
FIG. 7 is a cross-sectional view of a cushioning member of the article of footwear of FIG. 1 taken along Line 7-7 of FIG. 6.
Figure 8:
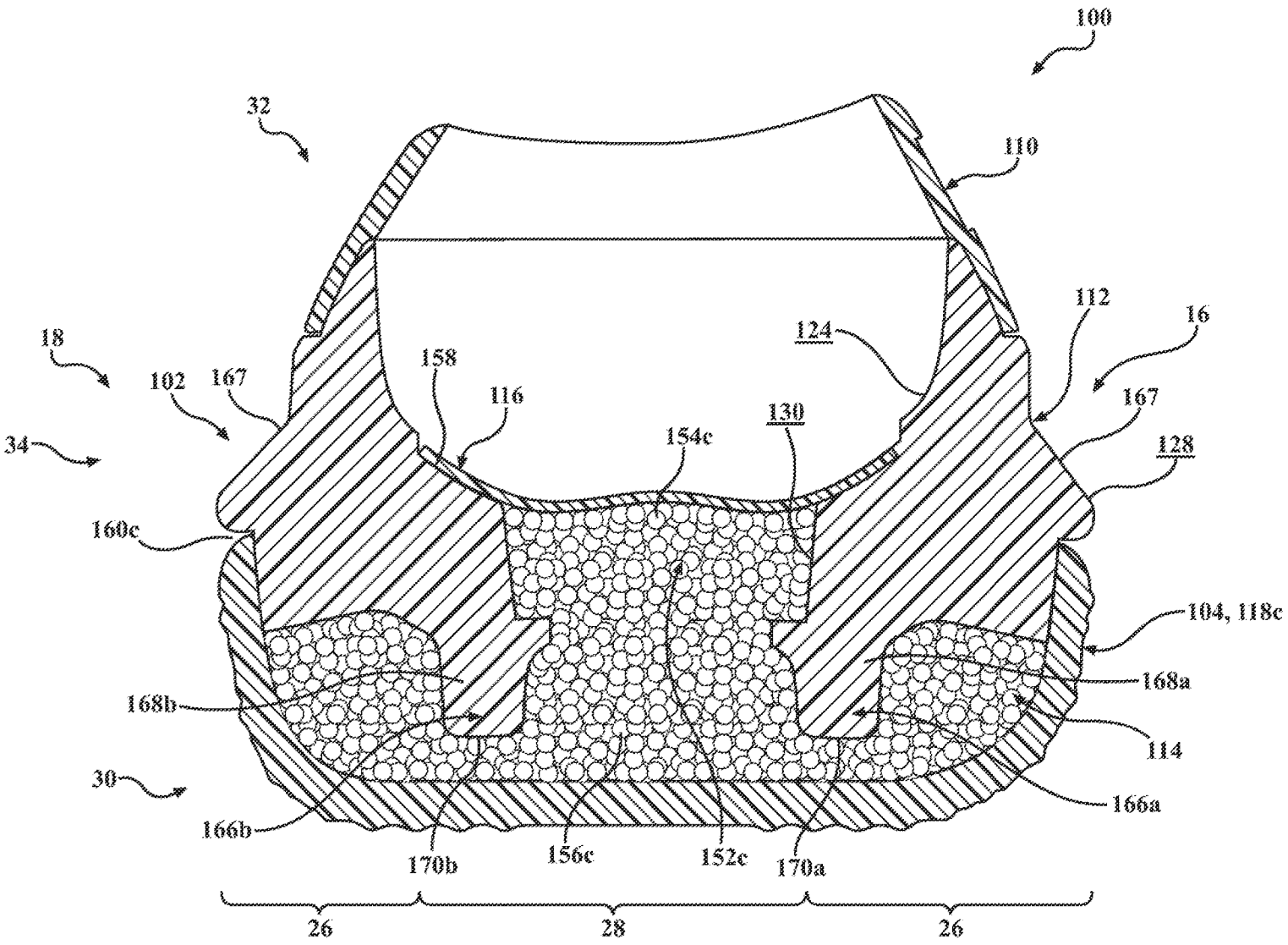
FIG. 8 is a cross-sectional view of a cushioning member of the article of footwear of FIG. 1 taken along Line 8-8 of FIG. 6.

The article of footwear 10 may be divided into one or more regions. The regions may include a forefoot region 20, a mid-foot region 22, and a heel region 24. As illustrated in FIGS. 6 and 7, the forefoot region 20 may be further subdivided into a toe portion 20T corresponding with phalanges and a ball portion 12B associated with metatarsal bones of a foot. The mid-foot region 22 may correspond with an arch area of the foot, and the heel region 24 may correspond with rear portions of the foot, including a calcaneus bone.

Figure 3:
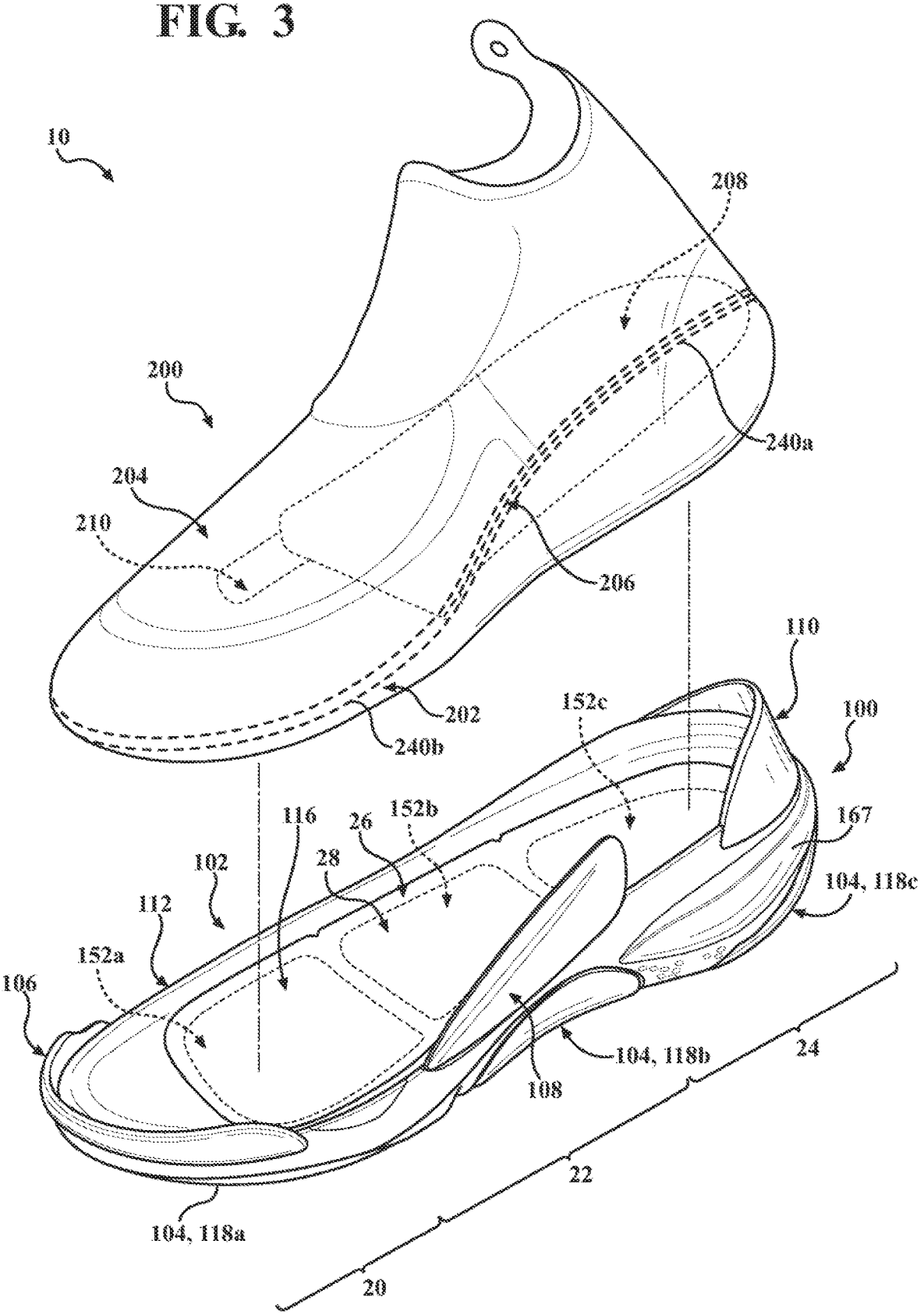
FIG. 3 is an exploded perspective view of the article of footwear of FIG. 1, showing a sole structure and a bootie of the article of footwear.

The article of footwear 10 may be further described as including a peripheral region 26 and an interior region 28, as indicated in FIG. 3. The peripheral region 26 is generally described as being a region between the interior region 28 and an outer perimeter of the sole structure 100. Particularly, the peripheral region 26 extends from the forefoot region 20 to the heel region 24 along each of the medial side 16 and the lateral side 18, and wraps around each of the anterior end 12 and the posterior end 14. The interior region 28 is circumscribed by the peripheral region 26, and extends from the forefoot region 20 to the heel region 24 along a central portion of the sole structure 100. Accordingly, each of the forefoot region 20, the mid-foot region 22, and the heel region 24 may be described as including the peripheral region 26 and the interior region 28.

Components of the article of footwear 10 may be further defined in terms of a vertical position on the article of footwear 10. For example, the article of footwear 10 includes a plantar region 30 on the bottom of the article of footwear 10 and configured to oppose or support a plantar surface of the foot. A dorsal region 32 is formed on an opposite side of the article 10 from the plantar region 30, and extends along a top side of the article of footwear 10 and receives a dorsal portion of the foot. A side region 34 extends along the medial side 16 and the lateral side 18 between the plantar region 30 and the dorsal region 32 and surrounds an outer periphery of the foot.

Figure 4:
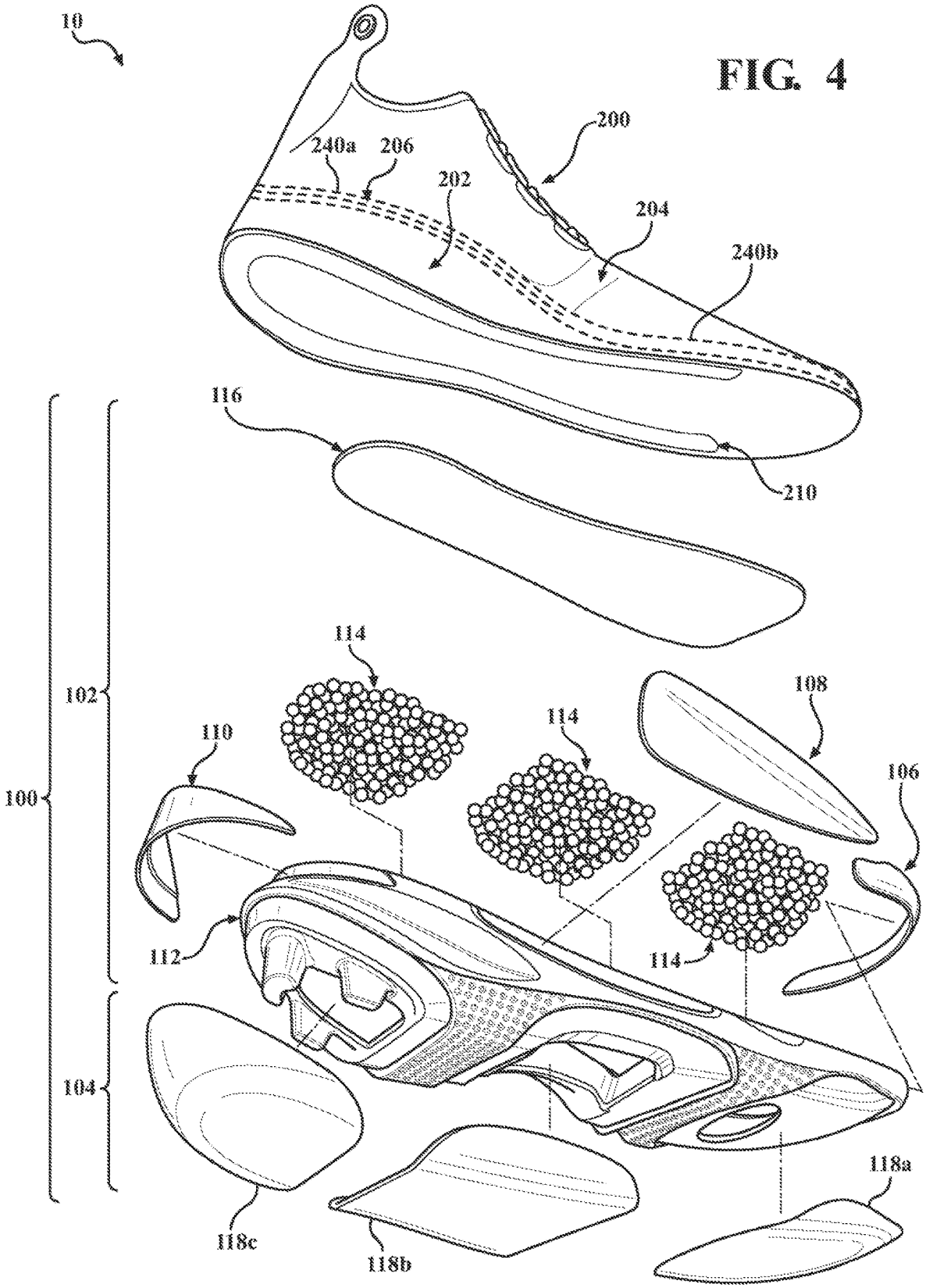
FIG. 4 is an exploded bottom perspective view of the article of footwear of FIG. 1, showing the sole structure exploded from the bootie.

With reference to FIG. 4, the sole structure 100 includes a midsole 102 configured to impart properties of cushioning and responsiveness, and an outsole 104 configured to impart properties of traction and abrasion resistance. The midsole 102 and the outsole 104 may cooperate to define a ground engaging surface 36 along the plantar region 30 of the article of footwear 10. The sole structure 100 may further include one or more directional supports, such as a toe cap 106 disposed at the anterior end 12 of the midsole 102, a saddle 108 extending from the medial side 18 of the midsole 102, and a heel clip 110 extending from the posterior end 14 of the midsole 102. As detailed below, the midsole 102 includes a cushioning element 112, a plurality of cushioning particles 114 received by the cushioning element 112, and an upper barrier layer 116 attached to the top of the cushioning element 112 to enclose the cushioning particles 114 on a first side of the cushioning element 112. The outsole 104 may include a plurality of outsole elements 118*a*-118*c* attached to an opposite side of the cushioning element 112 from the upper barrier layer 116 to enclose the cushioning particles 114 within the midsole 102.

Referring to FIGS. 9-12, the cushioning element 112 of the midsole 102 extends from a first end 120 disposed at the anterior end 12 of the footwear 10 to a second end 122 disposed at the posterior end 14 of the footwear 10. The cushioning element 112 further includes a top surface 124 and a bottom surface 126 formed on an opposite side from the top surface 124. A distance between the top surface 124 and the bottom surface 126 defines a thickness of the cushioning element 112. An outer side surface 128 extends from the top surface 124 to the bottom surface 126 and defines an outer peripheral profile of the cushioning element 112.

The cushioning element 112 further includes an inner side surface 130 spaced inwardly from the outer side surface 128 and extending continuously from the top surface 124 to the bottom surface 126 to form a channel 132 through the thickness of the cushioning element 112. As shown, the inner side surface 130 is formed between the peripheral region 26 and the interior region 28 in the forefoot region 20, the midfoot region 22, and the heel region 24. Accordingly, the channel 132 is substantially formed within the interior region 28 of the cushioning element 112, and extends continuously from a first end 134 in the forefoot region 20 to a second end 136 in the heel region 24. In the illustrated example, the first end 134 is disposed between the toe portion 20T and a ball portion 20B of the forefoot region 20, such that the channel 132 extends through the ball portion 20B, and the toe portion 20B is supported by the top surface 124 of the cushioning element 112. Accordingly, the top surface 124 of the cushioning element 112 extends along the peripheral region 26 in the forefoot region 20, the midfoot region 22, and the heel region 24. In other examples, the channel 132 may extend through the entire forefoot region 20, such that the toe portion 20T is also supported by the cushioning particles 114 when the sole structure 100 is assembled.

The cushioning element 112 includes one or more ribs 138*a*, 138*b* configured to separate the channel 132 into a plurality of pockets 152*a*-152*c* for receiving the cushioning particles 114. In the illustrated example, the one or more ribs 138*a*, 138*b* includes a first rib 138*a* disposed between the forefoot region 20 and the midfoot region 22, and a second rib 138*b* disposed between the midfoot region 22 and the heel region 24. In other examples, the cushioning element 112 may include different numbers of the ribs 138*a*, 138*b*. For example, where the channel 132 extends along an entirety of the interior region 28 of the cushioning element 112, the cushioning element 112 may include three or more ribs to divide the channel 132 into four or more pockets. Here, at least one of the pockets may be disposed within the toe portion 20T.

Figure 9:
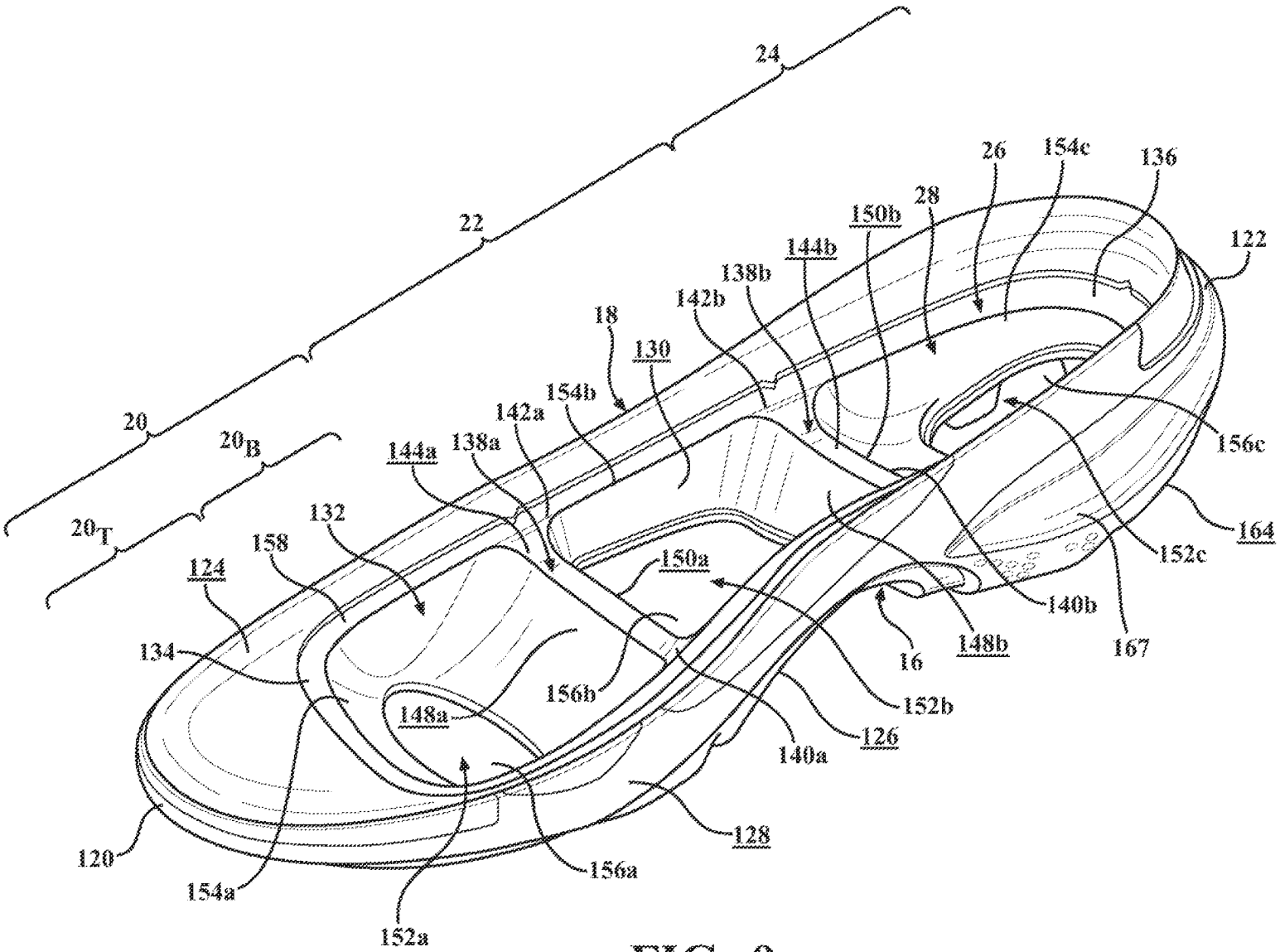
FIG. 9 is a top perspective view of a cushioning element of the article of footwear of FIG. 1.
Figure 10:
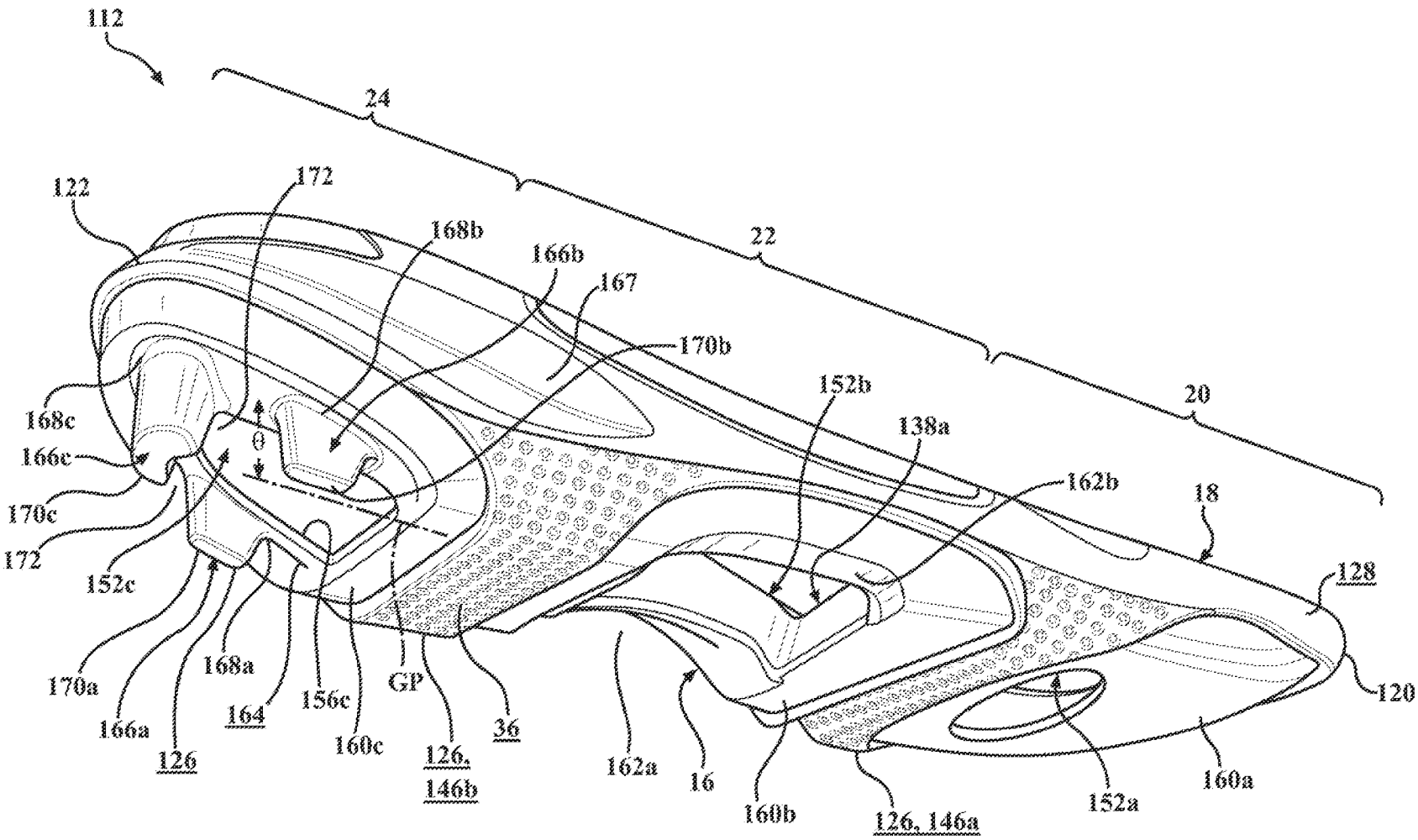
FIG. 10 is a bottom perspective view of the cushioning element of FIG. 9.

Each of the ribs 138*a*, 138*b* extends across the channel 132 from a first end 140*a*, 140*b* attached to the inner side surface 130 on the medial side 16 to a second end 142*a*, 142*b* attached to the inner side surface 130 on the lateral side 18. As shown in FIGS. 9 and 10, the ribs 138*a*, 138*b* further include an upper surface 144*a*, 144*b* formed at the top surface 124 of the cushioning element 112 and a lower surface 146*a*, 146*b* formed at the bottom surface 126 of the cushioning element 112. The upper surface 144*a*, 144*b* of each rib 138*a*, 138*b* may be offset or recessed from the top surface 124 of the cushioning element 112 by a distance. The lower surface 146*a*, 146*b* of each rib 138*a*, 138*b* may be coincident with the bottom surface 126 of the cushioning element 112, and may form a portion of the ground-engaging surface 36 of the sole structure 100.

With reference to FIG. 7, each rib 138*a*, 138*b* may further include an anterior side surface 148*a*, 148*b* extending from the upper surface 144*a*, 144*b* towards the lower surface 146*a*, 146*b* and facing the anterior end 12. Each rib 138*a*, 138*b* may also include a posterior side surface 150*a*, 150*b* extending from the upper surface 144*a*, 144*b* towards the lower surface 146*a*, 146*b* and facing the posterior end 14. A distance from the anterior side surface 146*a*, 146*b* to the posterior side surface 148*a*, 148*b* defines a width $W_{138a}$, $W_{138b}$ of each rib 138*a*, 138*b*. In the illustrated example, the widths $W_{138}$ of the ribs 138*a*, 138*b* increase along a direction from the upper surface 144*a*, 144*b* to the lower surface 146*a*, 146*b*. Accordingly each rib 138*a*, 138*b* is configured such that a stiffness progressively increases as compression towards the lower surface 146 increases. The anterior side surface 148*a* of the first rib 138*a* and the posterior side surface 148*b* of the second rib 138*b* may have concave profiles, while the posterior side surface 150*a* of the first rib 138*a* and the anterior side surface 148*b* of the second rib 138*b* may be substantially straight.

Referring again to FIGS. 9-12, the ribs 138*a*, 138*b* separate the channel 132 into a forefoot pocket 152*a* disposed on an anterior side of the first rib 138*a*, a midfoot pocket 152*b* disposed between the first rib 138*a* and the second rib 138*b*, and a heel pocket 152*c* disposed on a posterior side of the second rib 138*b*. Each of the forefoot pocket 152*a*, the midfoot pocket 152*b*, and the heel pocket 152*c* extends from a respective top opening 154*a*-154*c* formed through the top surface 124 to a bottom opening 156*a*-156*c* formed through the bottom surface 126. As discussed above, the widths $W_{138a}$, $W_{138b}$ of the ribs 138*a*, 138*b* may progressively increase in a direction from the top surface 124 to the bottom surface 126. Accordingly, a cross-sectional area of one or more of the pockets 152*a*-152*c* may progressively decrease along the direction from the top surface 124 to the bottom surface 126.

Figure 11:
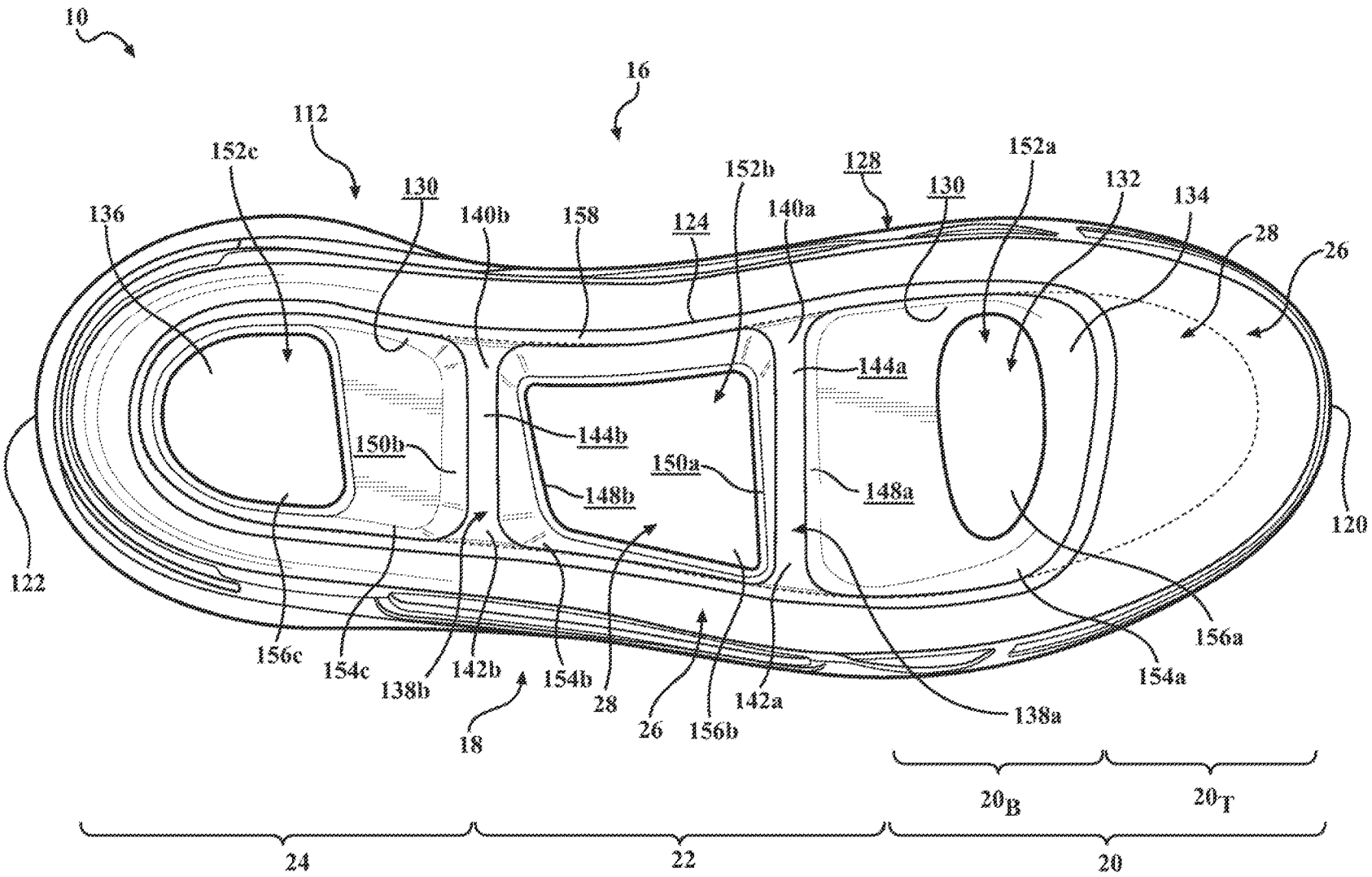
FIG. 11 is a top plan view of the cushioning element of FIG. 9.

With continued reference to FIGS. 9-12, the top surface 124 and the bottom surface 126 of the cushioning element 112 include a plurality of recesses for receiving covers or enclosures for the pockets 152*a*-152*c*. As shown in FIGS. 9 and 11, the top surface 124 includes a top recess 158 extending outwardly from the inner side surface 130 of the cushioning element 112. A peripheral profile of the top recess 158 corresponds to an outer peripheral profile of the upper barrier layer 116 and a depth of the top recess 158 corresponds to a thickness of the upper barrier layer 116. Accordingly, the top recess 158 is configured to receive the upper barrier layer 116 such that a top surface of the upper barrier layer 116 is flush with the top surface 124 of the cushioning element 112 when the sole structure 100 is assembled, as shown in FIG. 7.

The bottom surface 126 of the cushioning element 112 further includes a plurality of outsole recesses 160*a*-160*c* corresponding to the bottom openings 156*a*-156*c* of each of the pockets 152*a*-152*c*. For example, each of the outsole recesses 160*a*-160*c* may extend outwardly from one of the bottom openings 156*a*-156*c* to provide a receptacle for receiving one of the outsole elements 118*a*-118*c*. Accordingly, the outsole recesses 160*a*-160*c* are configured with a depth corresponding to thicknesses of the respective outsole elements 118*a*-118*c*, while a peripheral profile of each outsole recess 160*a*-160*c* corresponds to a peripheral profile of one of the outsole elements 118*a*-118*c*.

With continued reference to FIG. 10, the cushioning element 112 may be provided with one or more windows 162*a*, 162*b* formed through the peripheral region 26 of the cushioning element 112 and into one of the pockets 152*a*-152*c*. For example, the cushioning element 112 includes a first pair of windows 162*a*, 162*b* formed in the bottom surface 126 and extending through the peripheral region 26 from the outer side surface 128 to the inner side surface 130. As shown, the windows 162*a*, 162*b* include a first window 162*a* extending into the midfoot pocket 152*b* on the medial side 16, and a second window 162*b* extending into the midfoot pocket 152*b* on the lateral side 18. Each of the windows 162*a*, 162*b* provides a space through with the cushioning particles 114 can flow between the cushioning element 112 and the outsole 104 when the sole structure 100 is assembled. Accordingly, cushioning particles 114 may be disposed against, and visible through, the midfoot outsole element 118*b* along the outer periphery of the sole structure 100.

Referring still to FIG. 10, the heel region 24 of the cushioning element 112 may include a ramp surface 164 formed around the bottom opening 156*c* of the heel pocket 152*c*. Generally, the ramp surface 164 is offset and spaced apart from the bottom surface 126. As shown, the ramp surface 164 extends towards the top surface 124, such that the ramp surface 164 is spaced apart from a ground plane GP in the heel region. In one configuration, the ramp surface 164 is formed at an oblique angle θ relative to the ground-engaging surface 36 of the sole structure 100, such that the ramp surface 164 extends away from the ground plane GP at the angle θ along a direction from the midfoot region 22 to the posterior end 14.

The heel region 24 of the cushioning element further includes one or more pillars 166*a*-166*c* projecting downwardly from the ramp surface 164. Accordingly, each of the pillars 166*a*-166*c* extends from a proximal end 168*a*-168*c* attached at the ramp surface 164 to a terminal, distal end 170*a*-170*c* formed at an opposite end of the pillar 166*a*-166*c*. The distal ends 170*a*-170*c* are configured to interface with the heel outsole element 118*c* when the sole structure 100 is assembled, thereby providing support to the article of footwear 10 in the heel region 24. Accordingly, the distal ends 170*a*-170*c* may by understood as forming a portion of the bottom surface 126 of the cushioning element 112. A cross-sectional area of one or more of the pillars 166*a*-166*c* may decrease along a direction from the proximal end 168*a*-168*c* to the distal end 170*a*-170*c*. For example, at least one of a width and/or a length of the one or more pillars 166*a*-166*c* may taper along a height direction from the proximal end 168*a*-168*c* to the distal end 170*a*-170*c*.

Figure 12:
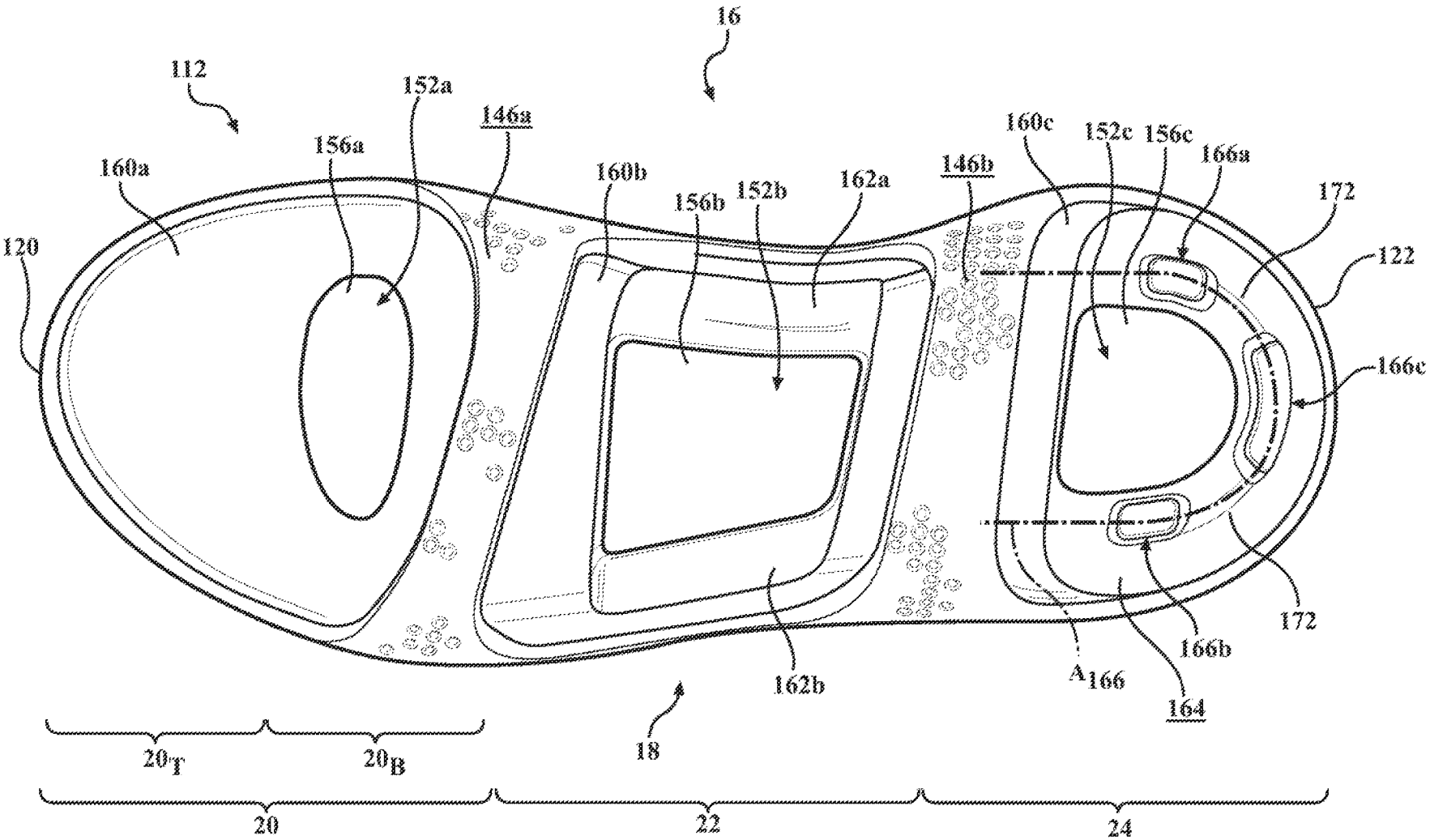
FIG. 12 is a bottom plan view of the cushioning element of FIG. 9.

In the illustrated example, the one or more pillars 166*a*-166*c* includes a series of pillars 166*a*-166*c* arranged around the bottom opening 156*c* of the heel pocket 152*c*. Particularly, the series of pillars 166*a*-166*c* includes a medial pillar 166*a* disposed on the medial side 16 of the bottom opening 156*c*, a lateral pillar 166*b* disposed on the lateral side 18 of the bottom opening 156*c*, and a posterior pillar 166*c* disposed on a posterior end of the bottom opening 156*c*. As shown in FIG. 12, the pillars 166*a*-166*c* are aligned in series along an outer periphery of the bottom opening 156*c*. Here, the pillars 166*a*-166*c* are arranged in series along a horseshoe-shaped, arcuate path or axis $A_{166}$ corresponding to the curvature of the posterior end 14 of the sole structure 100. The pillars 166*a*-166*c* may be spaced apart from each other along the axis $A_{166}$ to provide a series of gaps 172 disposed between adjacent pillars 166*a*-166*c*. These gaps 172 maximize flow of the cushioning particles 114 within the heel region 24, as the cushioning particles 114 are able to flow freely between adjacent ones of the pillars 166*a*-166*c*.

In some examples, the heel region 24 of the cushioning element may include a relief 167 formed in the outer side surface 128. The relief 167 extends continuously around the heel region 24 from a first end on the medial side 16 to ta second end on the lateral side 18. The relief 167 is configured to allow the peripheral region 26 and, particularly, the outer side surface 128, to act as a spring or living hinge, thereby allowing the cushioning element 112 to compress in the heel region 24.

The cushioning element 112 is formed of one or more resilient polymeric materials, such as foam or rubber, to impart properties of cushioning, responsiveness, and energy distribution to the foot of the wearer. In the illustrated example, the cushioning element 112 is formed as a composite, whereby different components of the cushioning element 112 are formed of different materials to impart different properties to the sole structure 100. For example, the peripheral region 26 of the cushioning element 112 may be formed of a first polymeric material having a first durometer, while the ribs 138*a*-138*b*, or at least a top portion of the ribs 138*a*-138*b*, are formed of a second polymeric material having a lower durometer than the peripheral region 26. Accordingly, the ribs 138*a*-138*b* can be more easily compressed, and will provide a softer feel along the footbed to minimize point loads along the plantar surface of the foot.

Example resilient polymeric materials for the cushioning element 112 may include those based on foaming or molding one or more polymers, such as one or more elastomers (e.g., thermoplastic elastomers (TPE)). The one or more polymers may include aliphatic polymers, aromatic polymers, or mixtures of both; and may include homopolymers, copolymers (including terpolymers), or mixtures of both.

In some aspects, the one or more polymers may include olefinic homopolymers, olefinic copolymers, or blends thereof. Examples of olefinic polymers include polyethylene, polypropylene, and combinations thereof. In other aspects, the one or more polymers may include one or more ethylene copolymers, such as, ethylene-vinyl acetate (EVA) copolymers, EVOH copolymers, ethylene-ethyl acrylate copolymers, ethylene-unsaturated mono-fatty acid copolymers, and combinations thereof.

In further aspects, the one or more polymers may include one or more polyacrylates, such as polyacrylic acid, esters of polyacrylic acid, polyacrylonitrile, polyacrylic acetate, polymethyl acrylate, polyethyl acrylate, polybutyl acrylate, polymethyl methacrylate, and polyvinyl acetate; including derivatives thereof, copolymers thereof, and any combinations thereof.

In yet further aspects, the one or more polymers may include one or more ionomeric polymers. In these aspects, the ionomeric polymers may include polymers with carboxylic acid functional groups, sulfonic acid functional groups, salts thereof (e.g., sodium, magnesium, potassium, etc.), and/or anhydrides thereof. For instance, the ionomeric polymer(s) may include one or more fatty acid-modified ionomeric polymers, polystyrene sulfonate, ethylene-methacrylic acid copolymers, and combinations thereof.

In further aspects, the one or more polymers may include one or more styrenic block copolymers, such as acrylonitrile butadiene styrene block copolymers, styrene acrylonitrile block copolymers, styrene ethylene butylene styrene block copolymers, styrene ethylene butadiene styrene block copolymers, styrene ethylene propylene styrene block copolymers, styrene butadiene styrene block copolymers, and combinations thereof.

In further aspects, the one or more polymers may include one or more polyamide copolymers (e.g., polyamide-polyether copolymers) and/or one or more polyurethanes (e.g., cross-linked polyurethanes and/or thermoplastic polyurethanes). As used herein, "polyurethane" refers to a copolymer (including oligomers) that contains a urethane group (—N(C═O)O—). These polyurethanes can contain additional groups such as ester, ether, urea, allophanate, biuret, carbodiimide, oxazolidinyl, isocynaurate, uretdione, carbonate, and the like, in addition to urethane groups. In an aspect, one or more of the polyurethanes can be produced by polymerizing one or more isocyanates with one or more polyols to produce copolymer chains having (—N(C═O)O—) linkages. Alternatively, the one or more polymers may include one or more natural and/or synthetic rubbers, such as butadiene and isoprene.

When the resilient polymeric material is a foamed polymeric material, the foamed material may be foamed using a physical blowing agent which phase transitions to a gas based on a change in temperature and/or pressure, or a chemical blowing agent which forms a gas when heated above its activation temperature. For example, the chemical blowing agent may be an azo compound such as adodicarbonamide, sodium bicarbonate, and/or an isocyanate.

In some embodiments, the foamed polymeric material may be a crosslinked foamed material. In these embodiments, a peroxide-based crosslinking agent such as dicumyl peroxide may be used. Furthermore, the foamed polymeric material may include one or more fillers such as pigments, modified or natural clays, modified or unmodified synthetic clays, talc glass fiber, powdered glass, modified or natural silica, calcium carbonate, mica, paper, wood chips, and the like.

The resilient polymeric material may be formed using a molding process. In one example, when the resilient polymeric material is a molded elastomer, the uncured elastomer (e.g., rubber) may be mixed in a Banbury mixer with an optional filler and a curing package such as a sulfur-based or peroxide-based curing package, calendared, formed into shape, placed in a mold, and vulcanized.

In another example, when the resilient polymeric material is a foamed material, the material may be foamed during a molding process, such as an injection molding process. A thermoplastic polymeric material may be melted in the barrel of an injection molding system and combined with a physical or chemical blowing agent and optionally a crosslinking agent, and then injected into a mold under conditions which activate the blowing agent, forming a molded foam.

Optionally, when the resilient polymeric material is a foamed material, the foamed material may be a compression molded foam. Compression molding may be used to alter the physical properties (e.g., density, stiffness and/or durometer) of a foam, or to alter the physical appearance of the foam (e.g., to fuse two or more pieces of foam, to shape the foam, etc.), or both.

The compression molding process desirably starts by forming one or more foam preforms, such as by injection molding and foaming a polymeric material, by forming foamed particles or beads, by cutting foamed sheet stock, and the like. The compression molded foam may then be made by placing the one or more preforms formed of foamed polymeric material(s) in a compression mold, and applying sufficient pressure to the one or more preforms to compress the one or more preforms in a closed mold. Once the mold is closed, sufficient heat and/or pressure is applied to the one or more preforms in the closed mold for a sufficient duration of time to alter the preform(s) by forming a skin on the outer surface of the compression molded foam, fuse individual foam particles to each other, permanently increase the density of the foam(s), or any combination thereof. Following the heating and/or application of pressure, the mold is opened and the molded foam article is removed from the mold.

The outsole 104 may include one or more discrete outsole elements 118*a*-118*c* that are separate from one another. The outsole elements 118*a*-118*c* may be formed from a transparent or translucent material. The outsole elements 118*a*-118*c* may be formed from a durable material such as, for example, rubber and may be attached to the bottom surface 126 of the cushioning element 112 at the respective recesses 160*a*-160*c*. Accordingly, the outsole elements 118*a*-118*c* may be attached to the bottom surface 126 of the cushioning element 112 proximate to the bottom openings 156*a*-156*c* respectively associated with the first pocket 152*a*, the second pocket 152*b*, and the third pocket 152*c*. Optionally, one or more of the outsole elements 118*a*-118*c* may include perforations formed therethrough, thereby allowing air to move into the channel 132 through the outsole 104 as the cushioning particles 114 within the sole structure 100 are compressed or decompressed.

The outsole elements 118*a*-118*c* may be separated from one another along a length of the sole structure 100 in a direction substantially parallel to the longitudinal axis $L_{10}$. While the outsole 104 is described and shown as including individual portions that are spaced apart from one another, the outsole 104 could alternatively have a unitary construction that extends generally across the entire bottom surface 126 of the cushioning element 112 such that the outsole 104 extends continuously between the anterior end 12 and the posterior end 14 and between the medial side 16 and the lateral side 18. Regardless of the particular construction of the outsole 104 (i.e., unitary or discrete portions), the outsole 104 may include treads that extend from the outsole 104 to provide increased traction with a ground surface during use of the article of footwear 10.

Forming the outsole 104 from a transparent or translucent material allows the pockets 152*a*-152*c* to be viewed through the outsole 104 when the outsole 104 is attached to the cushioning element 112 at the bottom surface 126. Further, because the cushioning particles 114 substantially fill the respective pockets 152*a*-152*c*, the interiors of the pockets 152*a*-152*c* and, thus, the cushioning particles 114 disposed therein are likewise visible at the bottom openings 156*a*-156*c* of the cushioning element 112 through the material of the outsole 104. Accordingly, the cushioning particles 114 residing within the respective pockets 152*a*-152*c* of the cushioning element 112 are visible through the outsole 104 at the bottom openings 156*a*-156*c*.

Figure 5:
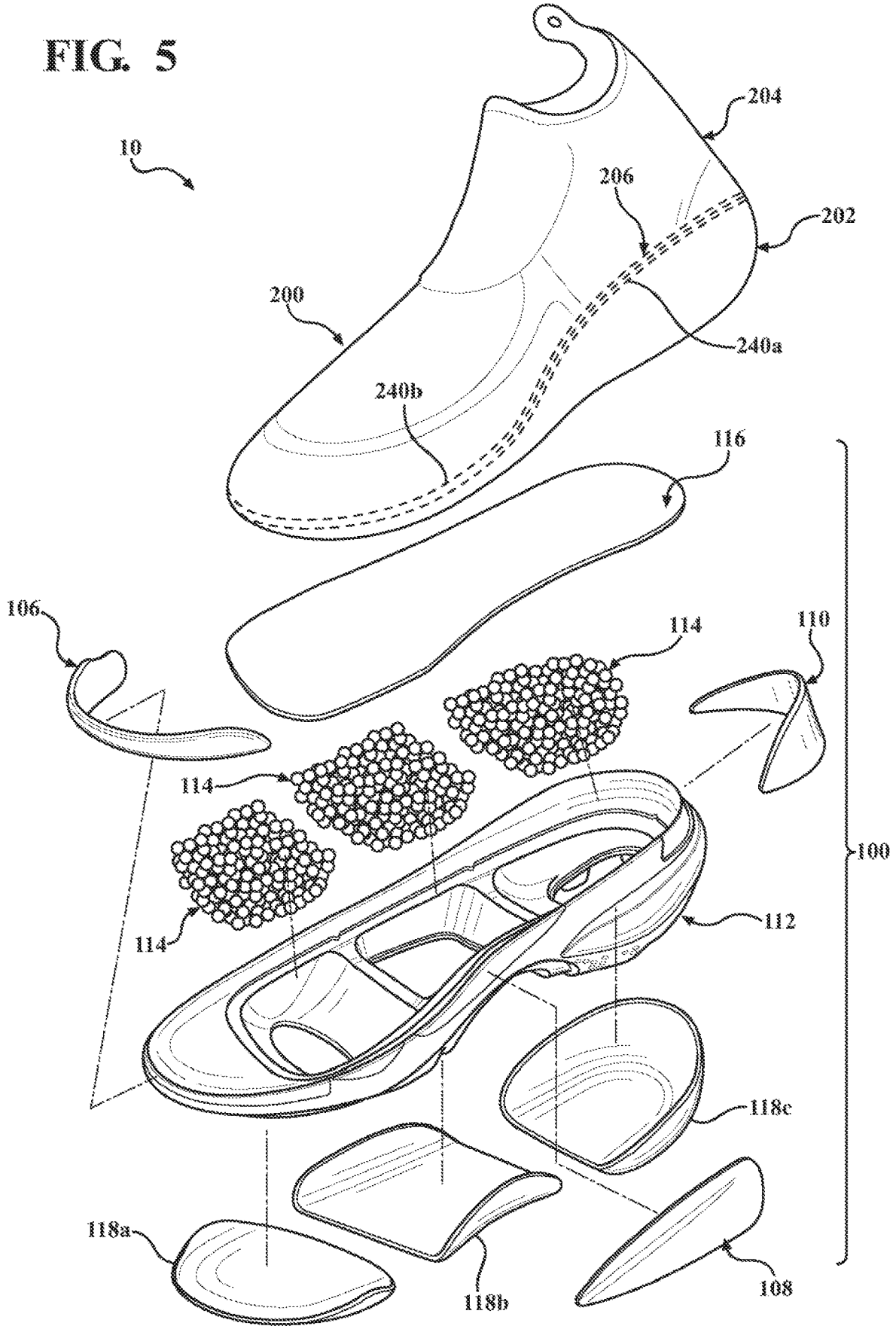
FIG. 5 is an exploded top perspective view of the article of footwear of FIG. 1, showing the sole structure exploded from the bootie.

With reference to FIGS. 5 and 7, the sole structure 100 includes volumes of the cushioning particles 114 disposed directly within each of the pockets 152*a*-152*c*. In other words, the cushioning particles 114 are not contained within an intermediate chamber or container, but are loosely disposed within each of the pockets 152*a*-152*c*. As shown in FIG. 7, each of the pockets 152*a*-152*c* is over-filled with a volume of the cushioning particles 114, such that the volume of cushioning particles 114 in each of the pockets 152*a*-152*c* extends above the upper surfaces 144*a*, 144*b* of the respective ribs 138*a*, 138*b*. Accordingly, the cushioning particles 114 will cooperate with the top surface 124 of the cushioning element 112 to support the plantar surface of the foot.

Regardless of the volume of the cushioning particles 114 disposed within the respective pockets 152*a*-152*c*, the cushioning particles 114 may be used to enhance the functionality and cushioning characteristics of the sole structure 100. The cushioning particles 114 contained within the pockets 152*a*-152*c* may include polymeric beads. For example, the cushioning particles 114 may be formed of any one of the resilient polymeric materials discussed above with respect to the cushioning element 112. In some examples, the cushioning particles 114 are formed of a foamed polyurethane (TPU) material, and have a substantially spherical shape. The foam beads defining the cushioning particles 114 may have approximately the same size and shape or, alternatively, may have at least one of a different size and shape. Regardless of the particular size and shape of the cushioning particles 114, the cushioning particles 114 cooperate with the cushioning element 112 and the outsole 104 to provide the article of footwear 10 with a cushioned and responsive performance during use.

With reference to FIG. 7, the upper barrier layer 116 is received within the top recess 158 of the cushioning element 112 to enclose the cushioning particles 114 within each of the respective pockets 152*a*-152*c*. Accordingly, the upper barrier layer 116 cooperates with the top surface 124 of the cushioning element 112 to form a support surface of the sole structure 100. The upper barrier layer 116 is formed of an air-permeable material, thereby allowing air to move in and out of the respective pockets 152*a*-152*c* as the cushioning particles 114 move between compressed and relaxed states. In some examples, the upper barrier layer 116 is formed of a knitted fabric material having a relatively high modulus of elasticity to allow the upper barrier layer 116 to stretch into the pockets 152*a*-152*c* when the sole structure 100 is compressed by a foot during use.

Incorporation of the cushioning particles 114 into the article of footwear 10 provides a degree of comfort and cushioning to a foot of a user during use. For example, when a force is applied on the upper barrier layer during use of the article footwear by a foot of a wearer, the force causes the upper barrier layer 116 to flex and stretch, thereby allowing the foot of the wearer to engage and displace the cushioning particles 114 disposed within the pockets 152*a*-152*c*. Such movement of the upper barrier layer 116 also compresses a material of the cushioning element 112 generally surrounding the pockets 152*a*-152*c* which, in turn, absorbs forces associated with a walking or running movement.

The toe cap 106, the saddle 108, and the heel clip 110 are each formed of a polymeric material having a greater rigidity than the cushioning element 112, and extend upwardly from the outer side surface 128 to provide areas of additional support to the bootie 200. As shown, the toe cap 106 is attached at the anterior end 12 and extends around the toe portion 20T from the medial side 16 to the lateral side 18. The saddle 108 is attached at the lateral side 18 in the midfoot region 22. The heel clip 110 is attached at the posterior end 14 and extends around the heel region 24 from the medial side 16 to the lateral side 18.

Figure 13:
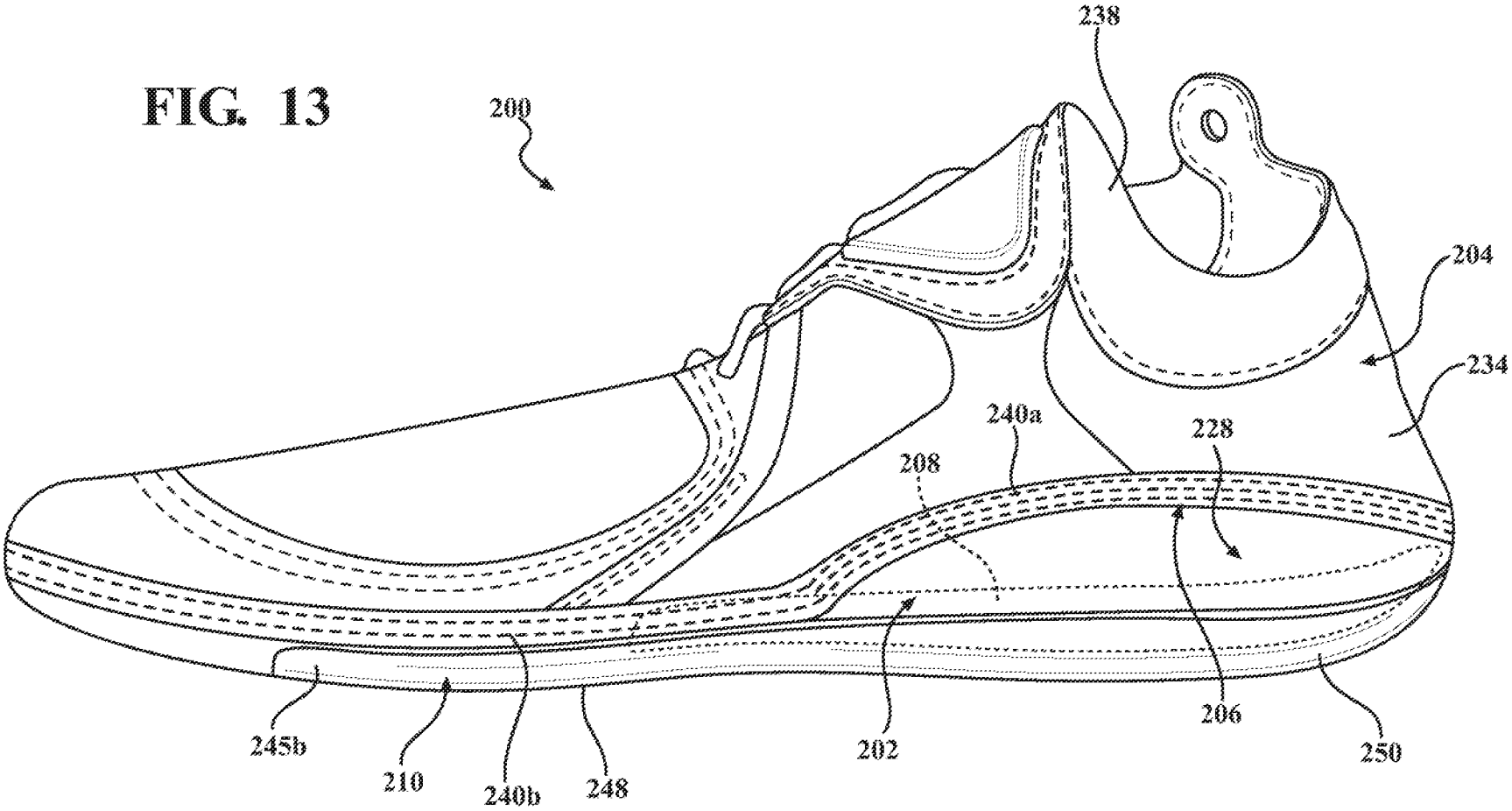
FIG. 13 is a lateral side elevation view of a bootie of the article of footwear of FIG. 1.
Figure 14:
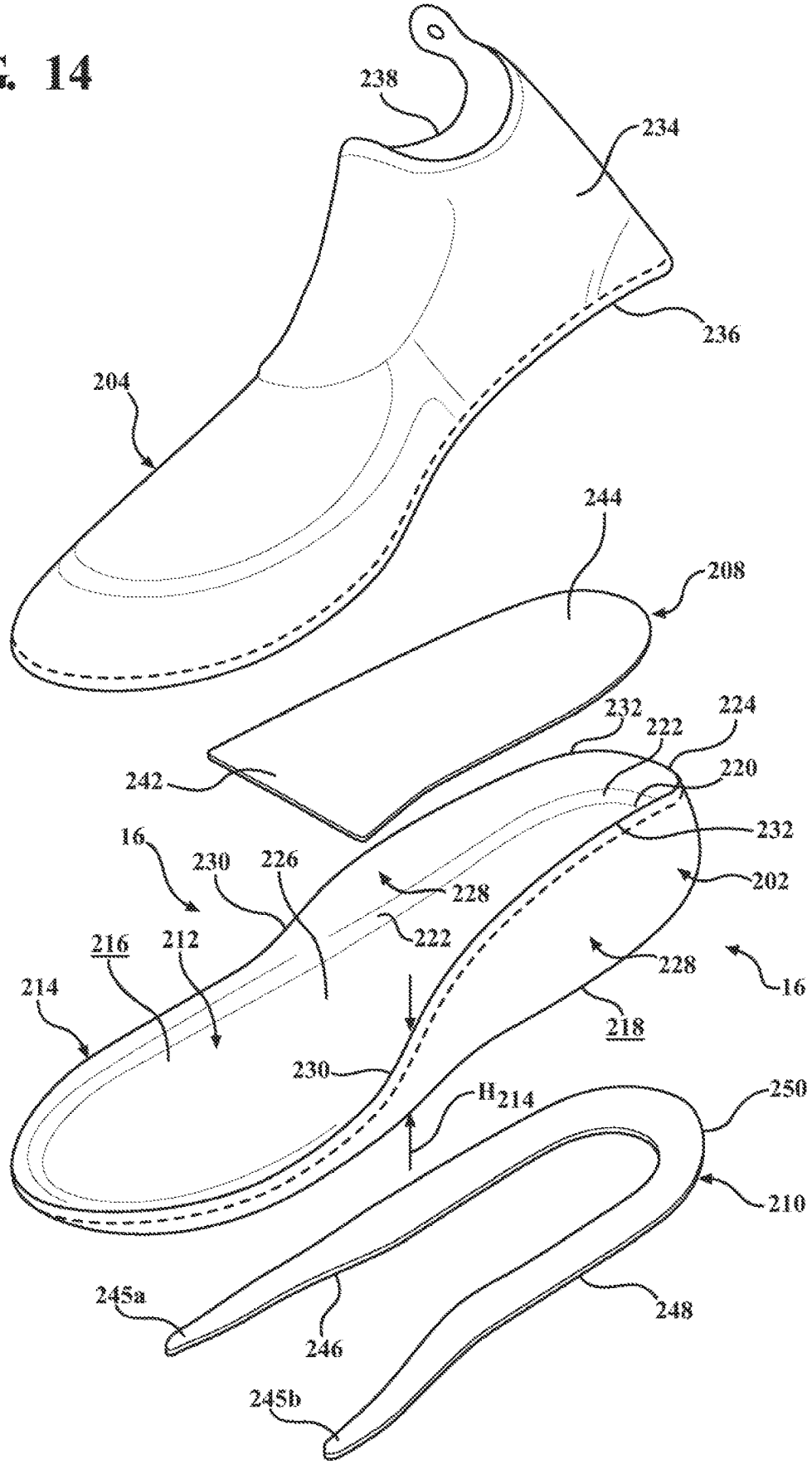
FIG. 14 is an exploded top perspective view of the bootie of FIG. 13.

With particular reference to FIGS. 13 and 14, a bootie 200 for the article of footwear 10 is shown. As described in greater detail below, the bootie 200 may be formed from one or more materials that are stitched or adhesively bonded together to form the interior void configured to receive and secure a foot for support on the sole structure 100. Suitable materials of the bootie 200 may include, but are not limited to, mesh, textiles, foam, leather, and synthetic leather. The materials may be selected and located to impart properties of durability, air-permeability, wear-resistance, flexibility, and comfort.

In some examples, the bootie 200 includes a strobel 202 and an upper 204 attached to an outer periphery of the strobel 202 along a peripheral seam 206 to define the interior void. For example, stitching or adhesives may secure the strobel 202 to the upper 204. An ankle opening is formed the heel region 24 and may provide access to the interior void. For example, the ankle opening may receive a foot to secure the foot within the void and facilitate entry and removal of the foot to and from the interior void. In some examples, one or more fasteners extend along the upper 204 to adjust a fit of the interior void around the foot and to accommodate entry and removal of the foot therefrom. The fasteners may include laces, straps, cords, hook-and-loop, or any other suitable type of fastener.

As described in greater detail below and shown in FIG. 14, the bootie 200 further includes an interior reinforcement member 208 configured to be attached to an interior surface of the strobel 202, within the interior void. An exterior reinforcement member 210 is disposed on an opposite side of the strobel 202 from the interior reinforcement member 208, such that the exterior reinforcement member 210 opposes the sole structure 100 when the article of footwear 10 is assembled.

As shown in FIG. 14, the strobel 202 includes a footbed 212 and a peripheral wall 214 extending transversely (i.e., not parallel) from the footbed 212. The footbed 212 is substantially flat, but may be contoured to conform to a profile of the bottom surface (e.g., plantar) of the foot. The footbed 212 includes an interior surface 216 and an exterior surface 218 formed on an opposite side of the footbed 212 from the interior surface 216. The interior surface 216 is configured to enclose a bottom portion of the interior void and to support a plantar surface of the foot when the foot is disposed within the interior void. The exterior surface 218 is configured to oppose the sole structure 100, and may be attached to the top surface 124 of the cushioning element 112 and the upper barrier layer 116 when the bootie 200 is assembled to the sole structure 100. An outer periphery of the footbed 212 is defined by a peripheral edge 220, which corresponds to a peripheral profile of a plantar surface of a foot.

The peripheral wall 214 of the strobel 202 extends upwardly from a first end 222 attached to the peripheral edge 220 of the footbed 212 to a distal, upper terminal edge 224 spaced apart from the footbed 212. The peripheral edge 220 of the footbed 212 and the first end 222 of the peripheral wall 214 may cooperate to provide an arcuate or concave transition between a substantially flat portion of footbed 212 and a substantially upright portion of the peripheral wall 214. As shown, the footbed 212 and the peripheral wall 214 cooperate to define a cavity 226 for receiving the foot. In some examples, the peripheral wall 214 may extend only partially around the peripheral edge 220 of the footbed 212 such that at least a portion of the peripheral edge 220 is exposed.

In the illustrated example, the peripheral edge 220 of the footbed 212 and the first end 222 of the peripheral wall 214 are integral, such that the footbed 212 and the peripheral wall 214 are formed as a substantially continuous piece having no pronounced seams. In some examples, the strobel 202 is formed of a single piece of flexible or elastic material. In other examples, the strobel 202 may be constructed of different materials having different properties, where the materials are joined to each other in a seamless manner to provide a substantially continuous and flush piece of material. By forming the strobel 202 with a substantially continuous and seamless structure, an underfoot feel of the article of footwear 10 is improved, as the plantar surface of the foot will not be exposed to pronounced, stiff regions associated with traditional stitched seams.

Figure 2:
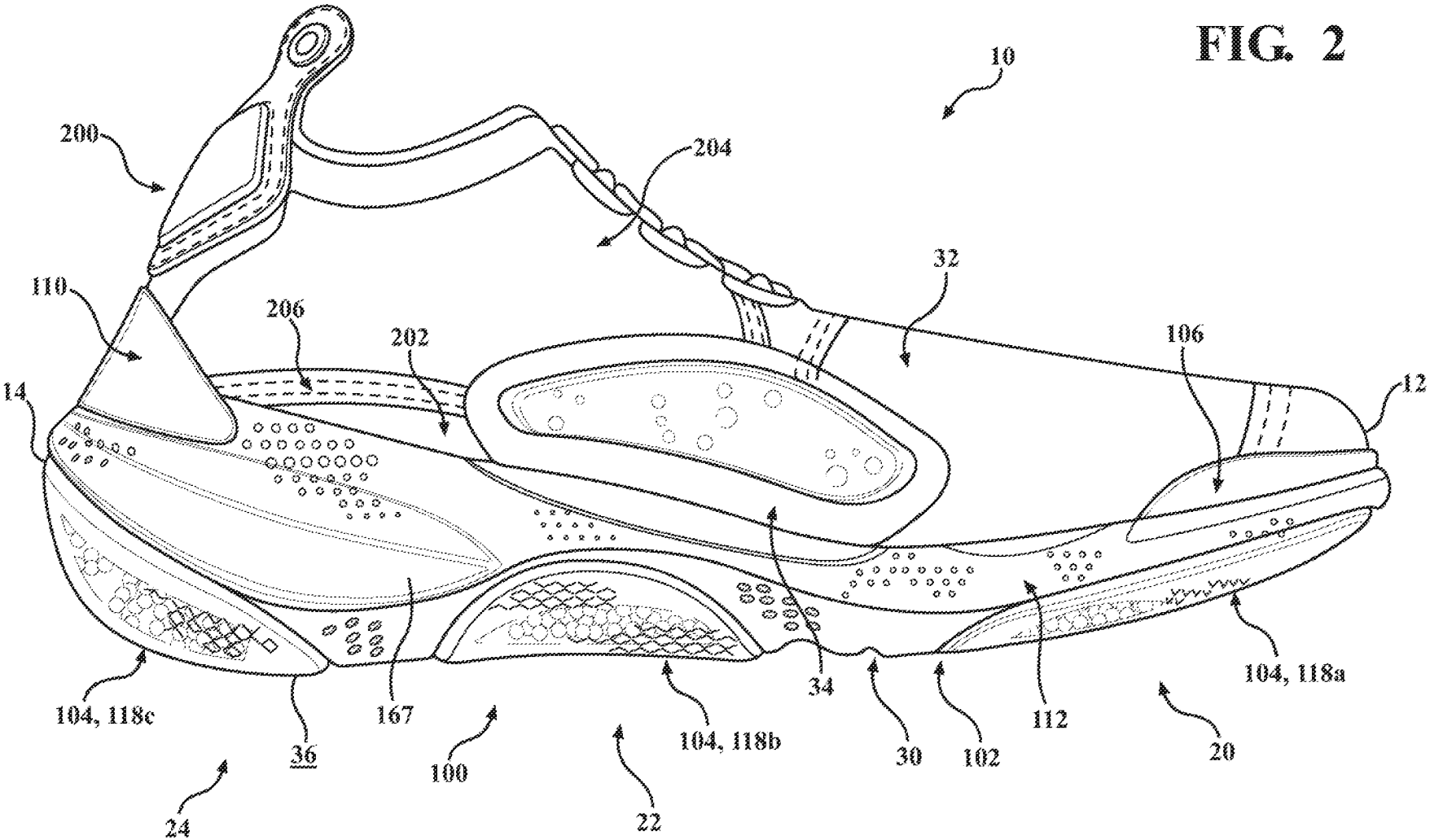
FIG. 2 is a medial elevation view of the article of footwear of FIG. 1.

A distance from the first end 222 of the peripheral wall 214 to the upper terminal edge 224 of the peripheral wall 214 defines a height $H_{214}$ of the peripheral wall 214 around the footbed 212. In some examples, the height $H_{214}$ of the peripheral wall 214 may be variable along the outer perimeter of the strobel 202. For example, the peripheral wall 214 may include one or more portions having a greater height $H_{214}$ than other portions. In the illustrated example, the peripheral wall 214 is formed with a pair of wings 228 extending from opposite sides of the footbed 212. A first one of the wings 228 extends from the medial side 16 of the footbed 212 and a second one of the wings 228 extends from the lateral side 18 of the footbed 212. Each of the wings 228 extends from a first end 230 in the midfoot region 22 to a second end 232 in the heel region 24. As shown in FIGS. 1 and 2, a height $H_{214}$ of the peripheral wall 214 along the wings 228 is selected so that when the article of footwear 10 is assembled, the wings 228 extend above a top edge of the sole structure 100. Accordingly, portions of the peripheral seam 206 extending along the wings 228 are exposed above the sole structure 100.

With continued reference to FIGS. 13 and 14, the upper 204 includes a sidewall 234 configured to surround a dorsal region of the foot when the article of footwear 10 is donned by the wearer. The sidewall 234 extends from a lower terminal edge 236 along the bottom of the upper 204 to a collar 238 defining the ankle opening at the top of the upper 204. As shown, a shape of the lower terminal edge 236 corresponds to the shape of the upper terminal edge 224 of the strobel 202, such that the lower terminal edge 236 can be mated with the upper terminal edge 224 to form the peripheral seam 206 when the bootie 200 is assembled.

The peripheral seam 206 extends continuously around the outer periphery of the bootie 200 to connect the strobel 202 to the upper 204. As discussed above, because the strobel 202 includes the peripheral wall 214, the peripheral seam 206 is positioned above the footbed 212, away from the plantar surface of the foot. More particularly, the peripheral seam 206 is arranged along sides 16, 18 of the bootie 200 in the midfoot region 22 so that vertical and lateral forces imparted on the sole structure 100 during movement are not applied to the peripheral seam 206 and the foot. Accordingly, the underfoot feel of the bootie 200 is improved.

The peripheral seam 206 may include a first stitching 240*a* in a first portion and a second stitching 240*b* in a second portion. For example, in the illustrated configuration, the peripheral seam 206 includes the first stitching 240*a* extending through the midfoot region 22 and around the heel region 24 and includes the second stitching extending from the midfoot region 22 and around the forefoot region 20. The first stitching may be an overlock stitching (e.g., surge stitching) and the second stitching may be a lock stitching (e.g., straight stitching).

With reference to FIG. 14, the bootie 200 includes the interior reinforcement member 208 and the exterior reinforcement member 210 attached to opposite sides of the footbed 212 from each other. The reinforcement members 208, 210 are each formed of a material having a greater stiffness than the material forming the footbed 212 of the strobel 202. Accordingly, the reinforcement members 208, 210 provide a desired degree of support and stability to the footbed 212. Each of the reinforcement members 208, 210 may be attached to the strobel 202 by adhesively bonding the reinforcement members 208, 210 to respective ones of the surfaces 216, 218 of the strobel 202.

The interior reinforcement member 208 is disposed on the interior surface 216 of the footbed 212 and extends continuously from a first end 242 disposed in the midfoot region 22 to a second end 244 disposed at the posterior end 14. Likewise, the interior reinforcement member 208 extends continuously from the medial side 16 to the lateral side 18 of the footbed 212. Accordingly, the interior reinforcement member 208 is formed as a substantially continuous element covering the midfoot region 22 and the heel region 24 of the interior surface 216 of the footbed 212.

The exterior reinforcement member 210 is disposed on the exterior surface 218 of the footbed 212 and extends continuously from the forefoot region 20 to the posterior end 14. However, unlike the interior reinforcement member 208, which covers the peripheral region 26 and the interior region 28 of the footbed 212, the exterior reinforcement member 210 extends only along the peripheral region 26 of the exterior surface 218. Here, the exterior reinforcement member 210 is U-shaped or horseshoe shaped and extends along the peripheral region 26 from a first end 245*a* disposed in the forefoot region 20 on the medial side 16 to a second end 245*b* disposed in the forefoot region 20 on the lateral side 18. Accordingly, the exterior reinforcement member 210 includes a medial segment 246 extending along the peripheral region 26 on the medial side 16, a lateral segment 248 extending along the peripheral region on the lateral side 18, and a posterior segment 250 extending around the posterior end 14 and connecting the medial segment 246 and the lateral segment 248.

As discussed above, the components 202, 204, 208, 210 of the bootie 200 may be formed of different materials to provide desired characteristics. For example, the strobel 202 may be formed of a first material having first material properties and the upper 204 may be formed of one or more second materials having second material properties. In some instances, the first material forming the strobel 202 has as higher modulus of elasticity than the second material(s) forming the upper 204. Furthermore, the reinforcement members 208, 210 are formed of a third material having a greater stiffness than the material of the strobel 202.

The following Clauses provide exemplary configurations of the sole structure and article of footwear described above.

Clause 1. An article of footwear comprising a strobel having an interior surface and an exterior surface formed on an opposite side from the interior surface, the strobel defining a footbed and a peripheral wall extending transversely from the footbed to a terminal edge. The article of footwear also includes an upper attached to the terminal edge of the strobel along a peripheral seam to define an interior void for receiving a foot, the peripheral seam configured to extend along a side of the interior void.

Clause 2. The article of footwear of Clause 1, further comprising a sole structure attached to the exterior surface of the footbed and having a sidewall extending partially over the peripheral wall of the strobel, the peripheral seam being exposed above the sidewall.

Clause 3. The article of footwear of any of the preceding Clauses, wherein the strobel is formed of a first material and the upper is formed of a second material different than the first material.

Clause 4. The article of footwear of any of the preceding Clauses, wherein the peripheral seam includes a first portion having a first stitching and a second portion having a second stitching.

Clause 5. The article of footwear of Clause 4, wherein the first stitching is an overlock stitching and the second stitching is a lock stitching.

Clause 6. The article of footwear of any of the preceding Clauses, further comprising at least one reinforcement member attached to the footbed of the strobel.

Clause 7. The article of footwear of Clause 6, wherein the at least one reinforcement member includes an interior reinforcement member attached to the interior surface of the strobel.

Clause 8. The article of footwear of Clause 7, wherein the interior reinforcement member extends from a heel region of the strobel to a mid-foot region of the strobel, and from a lateral side of the strobel to a medial side of the strobel.

Clause 9. The article of footwear of any of Clauses 6 to 8, wherein the at least one reinforcement member includes an exterior reinforcement member attached to the exterior surface of the strobel.

Clause 10. The article of footwear of Clause 9, wherein the exterior reinforcement member includes a first segment extending along a lateral side of the footbed, a second segment spaced apart from the first segment and extending along a medial side of the footbed, and a third segment connecting the first segment and the second segment and extending around a heel region of the footbed.

Clause 11. An article of footwear comprising a sole structure, a strobel including (i) a footbed disposed on the sole structure, and (ii) a peripheral wall extending transversely from the footbed to a terminal edge above the sole structure, and an upper attached to the terminal edge of the strobel along a peripheral seam.

Clause 12. The article of footwear of Clause 11, wherein the peripheral seam extends continuously around the article of footwear and is at least partially exposed above the sole structure.

Clause 13. The article of footwear of any of the preceding Clauses, wherein the strobel is formed of a first material and the upper is formed of a second material different than the first material.

Clause 14. The article of footwear of any of the preceding Clauses, wherein the peripheral seam includes a first portion having a first stitching and a second portion having a second stitching.

Clause 15. The article of footwear of Clause 14, wherein the first stitching is an overlock stitching and the second stitching is a lock stitching.

Clause 16. The article of footwear of any of the preceding Clauses, further comprising at least one reinforcement member attached to the footbed of the strobel.

Clause 17. The article of footwear of Clause 16, wherein the at least one reinforcement member includes an interior reinforcement member attached to the interior surface of the strobel.

Clause 18. The article of footwear of Clause 17, wherein the interior reinforcement member extends from a heel region of the strobel to a mid-foot region of the strobel, and from a lateral side of the strobel to a medial side of the strobel.

Clause 19. The article of footwear of any of Clauses 16 to 18, wherein the at least one reinforcement member includes an exterior reinforcement member attached to the exterior surface of the strobel.

Clause 20. The article of footwear of Clause 19, wherein the exterior reinforcement member includes a first segment extending along a lateral side of the footbed, a second segment spaced apart from the first segment and extending along a medial side of the footbed, and a third segment connecting the first segment and the second segment and extending around a heel region of the footbed.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

The invention claimed is:

1. An article of footwear comprising:

a strobel having an interior surface and an exterior surface formed on an opposite side from the interior surface, the strobel defining a footbed and a peripheral wall extending transversely from the footbed to a terminal edge;

an upper attached to the terminal edge of the strobel along a peripheral seam to define an interior void for receiving a foot, the peripheral seam configured to extend along a side of the interior void; and a sole structure attached to the exterior surface of the strobel and including a sidewall extending continuously along a length of the strobel, the sidewall having a first portion that extends over a majority of the peripheral seam at a medial side of the strobel and/or a lateral side of the strobel in a forefoot region of the strobel and a mid-foot region of the strobel and a second portion that is spaced apart from and below the peripheral seam at a heel region of the strobel to expose a portion of the strobel above the second portion of the sidewall, the peripheral seam including an arcuate shape that extends away from the second portion in a direction toward an ankle opening of the upper and includes a convex outer edge that opposes the ankle opening in the heel region.

2. The article of footwear of claim 1, wherein the first portion of the sidewall is disposed closer to an anterior end of the sole structure than the second portion of the sidewall.

3. The article of footwear of claim 1, wherein the strobel is formed of a first material and the upper is formed of a second material different than the first material.

4. The article of footwear of claim 1, wherein the peripheral seam includes a first portion having a first stitching and a second portion having a second stitching.

5. The article of footwear of claim 4, wherein the first stitching is an overlock stitching and the second stitching is a lock stitching.

6. The article of footwear of claim 1, further comprising at least one reinforcement member attached to the footbed of the strobel.

7. The article of footwear of claim 6, wherein the at least one reinforcement member includes an interior reinforcement member attached to the interior surface of the strobel.

8. The article of footwear of claim 7, wherein the interior reinforcement member extends from the heel region of the strobel to the mid-foot region of the strobel, and from the lateral side of the strobel to the medial side of the strobel.

9. The article of footwear of claim 6, wherein the at least one reinforcement member includes an exterior reinforcement member attached to the exterior surface of the strobel.

10. The article of footwear of claim 9, wherein the exterior reinforcement member includes a first segment extending along a lateral side of the footbed, a second segment spaced apart from the first segment and extending along a medial side of the footbed, and a third segment connecting the first segment and the second segment and extending around the heel region of the strobel.

11. An article of footwear comprising:

a sole structure;

a strobel including (i) a footbed disposed on the sole structure, and (ii) a peripheral wall extending transversely from the footbed to a terminal edge above the sole structure;

an upper attached to the terminal edge of the strobel along a peripheral seam; and wherein the sole structure is attached to an exterior surface of the strobel and includes a sidewall extending continuously along a length of the strobel, the sidewall having a first portion that extends over a majority of the peripheral seam at a medial side of the strobel and/or a lateral side of the strobel in a forefoot region of the strobel and a mid-foot region of the strobel and a second portion that (i) is spaced apart from the peripheral seam at a heel region of the strobel and (ii) is disposed between the peripheral seam and a ground-contacting surface of the sole structure to expose a portion of the strobel above the second portion of the sidewall, the peripheral seam including an arcuate shape that extends away from the second portion in a direction toward an ankle opening of the upper and includes a convex outer edge that opposes the ankle opening in the heel region.

12. The article of footwear of claim 11, wherein the peripheral seam extends continuously around the article of footwear.

13. The article of footwear of claim 11, wherein the strobel is formed of a first material and the upper is formed of a second material different than the first material.

14. The article of footwear of claim 11, wherein the peripheral seam includes a first portion having a first stitching and a second portion having a second stitching.

15. The article of footwear of claim 14, wherein the first stitching is an overlock stitching and the second stitching is a lock stitching.

16. The article of footwear of claim 11, further comprising at least one reinforcement member attached to the footbed of the strobel.

17. The article of footwear of claim 16, wherein the at least one reinforcement member includes an interior reinforcement member attached to an interior surface of the strobel.

18. The article of footwear of claim 17, wherein the interior reinforcement member extends from the heel region of the strobel to the mid-foot region of the strobel, and from the lateral side of the strobel to the medial side of the strobel.

19. The article of footwear of claim 16, wherein the at least one reinforcement member includes an exterior reinforcement member attached to an exterior surface of the strobel.

20. The article of footwear of claim 19, wherein the exterior reinforcement member includes a first segment extending along a lateral side of the footbed, a second segment spaced apart from the first segment and extending along a medial side of the footbed, and a third segment connecting the first segment and the second segment and extending around the heel region of the strobel.

* * * * *